US010760532B1

(12) United States Patent
Dudar

(10) Patent No.: US 10,760,532 B1
(45) Date of Patent: Sep. 1, 2020

(54) SYSTEMS AND METHODS FOR DIAGNOSING EJECTOR SYSTEM DEGRADATION FOR DUAL-PATH PURGE ENGINE SYSTEMS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/354,078

(22) Filed: Mar. 14, 2019

(51) Int. Cl.
*F02M 25/08* (2006.01)
*F02D 43/00* (2006.01)

(52) U.S. Cl.
CPC ..... *F02M 25/0809* (2013.01); *F02D 43/00* (2013.01); *F02M 25/089* (2013.01); *F02M 25/0836* (2013.01)

(58) Field of Classification Search
CPC ..... F02M 25/08–0836; F02M 25/089; F02D 41/003–0045; F02D 43/00
See application file for complete search history.

(56) References Cited

U.S. PATENT DOCUMENTS 7,900,608 B2 3/2011 Peters et al.
9,765,733 B2 * 9/2017 Tochihara ..... F02M 25/089
10,138,827 B2 11/2018 Dudar
2010/0224171 A1 9/2010 Peters et al.
2014/0196694 A1 * 7/2014 Euliss ..... F02M 25/0872 123/520
2016/0305352 A1 * 10/2016 Pursifull ..... F02M 35/104
2016/0341155 A1 * 11/2016 Dudar ..... F02B 37/164
2018/0030932 A1 * 2/2018 Dudar ..... F02M 25/0818
2018/0066595 A1 3/2018 Dudar et al.
2019/0107081 A1 4/2019 Dudar
2019/0368431 A1 * 12/2019 Dudar ..... F02D 41/003

* cited by examiner

*Primary Examiner* — Hung Q Nguyen
*Assistant Examiner* — Mark L. Greene
(74) *Attorney, Agent, or Firm* — Geoffrey Brumbaugh; McCoy Russell LLP

(57) ABSTRACT

Methods and systems are provided for conducting an ejector system diagnostic under conditions where an engine of a vehicle is not combusting air and fuel. In one example, a method comprises directing a positive pressure to the ejector system while the engine is off in order to communicate a negative pressure with respect to atmospheric pressure on a fuel system and an evaporative emissions system of the vehicle, and indicating that the ejector system is degraded responsive to the negative pressure not reaching a vacuum build threshold. In this way, the ejector system may be diagnosed under conditions where boosted engine operation is infrequent and/or of durations insufficient for conducting such an ejector system diagnostic.

20 Claims, 15 Drawing Sheets

SYSTEMS AND METHODS FOR DIAGNOSING EJECTOR SYSTEM DEGRADATION FOR DUAL-PATH PURGE ENGINE SYSTEMS

FIELD

The present description relates generally to methods and systems for conducting engine-off diagnostics on a vehicle ejector system of a dual-path purge engine system.

BACKGROUND/SUMMARY

Vehicles may be fitted with evaporative emission control systems such as onboard fuel vapor recovery systems. Such systems capture and prevent release of vaporized hydrocarbons to the atmosphere, for example fuel vapors generated in a vehicle gasoline tank during refueling. Specifically, the vaporized hydrocarbons (HCs) are stored in a fuel vapor canister packed with an adsorbent which adsorbs and stores the vapors. At a later time, when the engine is in operation, the evaporative emission control system allows the vapors to be purged into the engine intake manifold for use as fuel. The fuel vapor recovery system may include one more check valves, ejector(s), and/or controller actuatable valves for facilitating purge of stored vapors under boosted or non-boosted engine operation. Regulations require that hardware pertaining to the fuel vapor recovery system be regularly assessed for the presence or absence of degradation.

Toward this end, U.S. Pat. No. 7,900,608 discloses diagnosing fuel vapor recovery system hardware during boosted engine operation. However, the inventors herein have recognized potential issues with such methodology. Specifically, the methodology relies upon monitoring pressure changes in the fuel vapor recovery system during boosted engine operation. However, depending on fuel tank size and fuel fill level, there may be varying timeframes for which boosted engine operation can pressurize or evacuate the fuel vapor recovery system in order to robustly assess such pressure changes to indicate the presence or absence of degradation. For hybrid electric vehicles, engine run-time may be infrequent, thus limiting opportunity to conduct such diagnostics. Furthermore, it is additionally recognized that boosted engine operation duration may frequently be less than the time frame to sufficiently pressurize or evacuate the fuel vapor recovery system, thus undesirably leading to aborted diagnostic routines and/or inconclusive results.

Accordingly, discussed herein, the inventors have developed systems and methods to address the above-mentioned issues. In one example, a method comprises while an engine of a vehicle is off and when a set of predetermined conditions are met, directing a positive pressure with respect to atmospheric pressure into an ejector system in order to communicate a negative pressure with respect to atmospheric pressure on a fuel system and an evaporative emissions system, and indicating that the ejector system is degraded responsive to the negative pressure not reaching a vacuum build threshold. In this way, when such an ejector system diagnostic cannot be conducted during an engine-on condition, the diagnostic may be conducted during engine-off conditions, which may increase completions rates for such a diagnostic and which may in turn reduce opportunities for release of undesired emissions to atmosphere.

As one example, directing the positive pressure into the ejector system may comprise commanding a routing valve to a second routing valve position to selectively couple a pump to the ejector system by way of an engine-off boost conduit.

Alternatively, commanding the routing valve to a first routing valve position may selectively couple the pump to a vent line stemming from a fuel vapor storage canister positioned in the evaporative emissions system.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
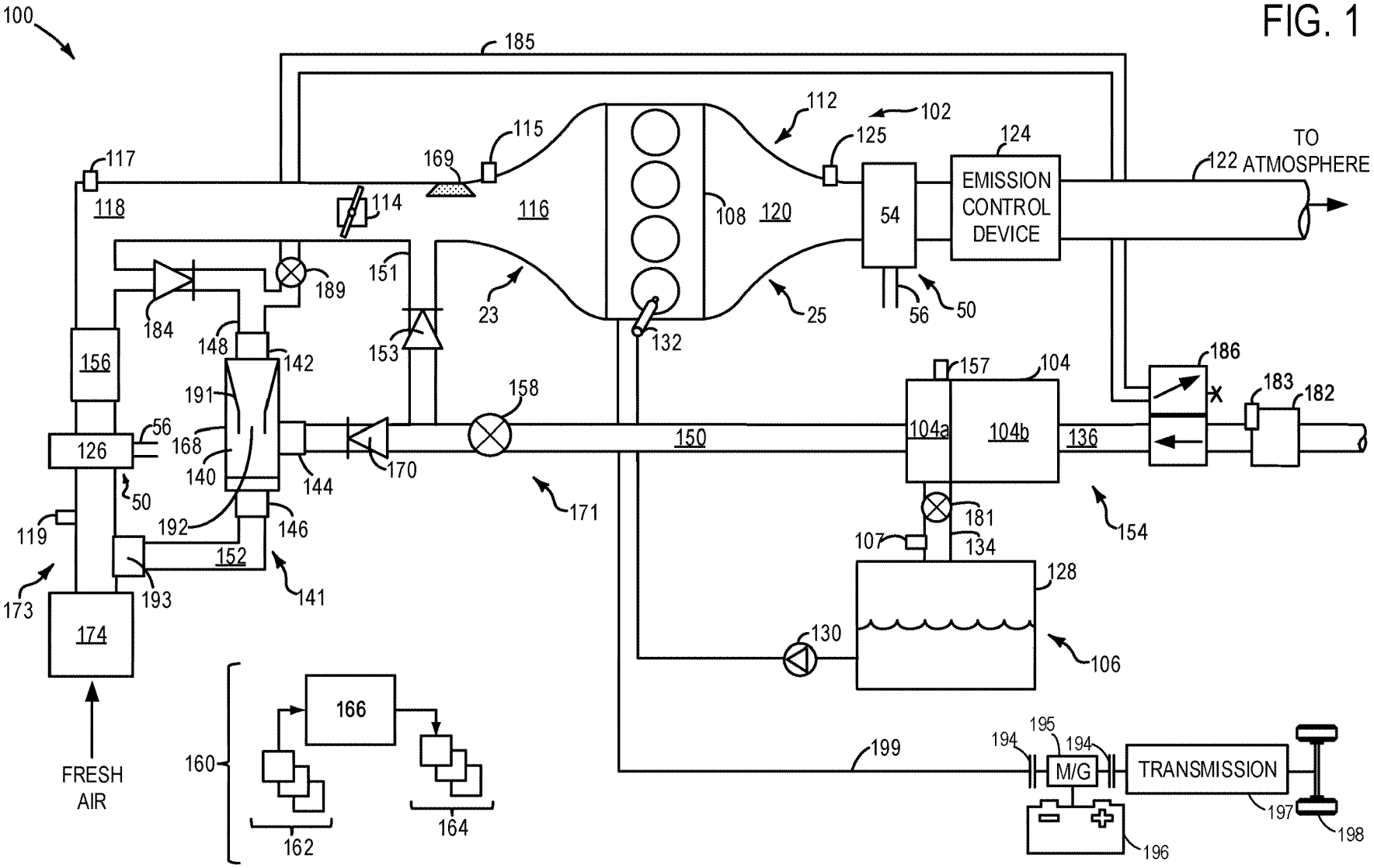
FIG. 1 shows a schematic diagram of a multi-path fuel vapor recovery system of a vehicle system where an ELCM pump is fluidically coupled to a fuel vapor storage canister.
Figure 2:
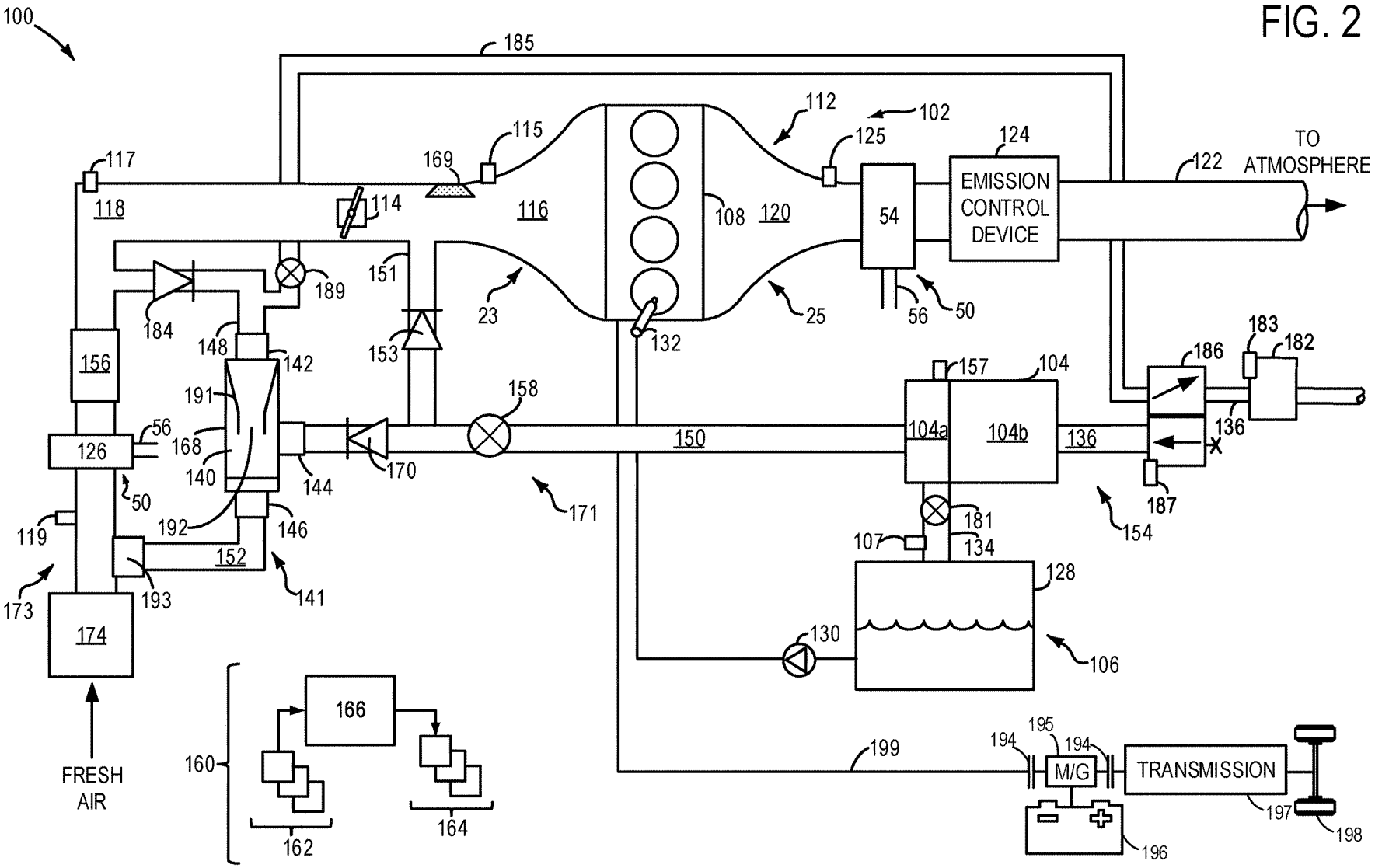
FIG. 2 shows an alternative schematic diagram of the multi-path fuel vapor recovery system of FIG. 1, where the ELCM pump is fluidically coupled to an ejector system.

The following description relates to systems and methods for conducting a diagnostic to assess functionality of an ejector system for a vehicle dual-path purge system, where the diagnostic does not rely on engine operation, or in other words, is independent of the engine combusting air and fuel. The diagnostic is based on an ability of an evaporative level check monitor (ELCM) pump to selectively be fluidically coupled to a fuel vapor storage canister under one condition, and to be fluidically coupled to the ejector system by way of an engine-off boost (EOBC) conduit under another condition. When the ELCM pump is fluidically coupled to the ejector system, the ELCM may be operated in a positive-pressure mode to supply pressurized air to the ejector system, and a resultant vacuum generated via the ejector system may be relied upon for ascertaining presence or absence of ejector system function. Accordingly, FIG. 1 depicts the dual-path purge system in a first configuration with the ELCM fluidically coupled to the fuel vapor storage canister. Alternatively, FIG. 2 depicts the dual-path purge system in a second configuration with the ELCM fluidically coupled to the engine-off boost conduit. FIGS. 3A-3D depict various ways in which the ELCM pump can operate, including a vacuum-mode and a pressure-mode of operation. To enable operation in either the vacuum-mode or the pressure-mode, an H-bridge is employed, as depicted at FIGS. 4A-4B.

Figure 5:
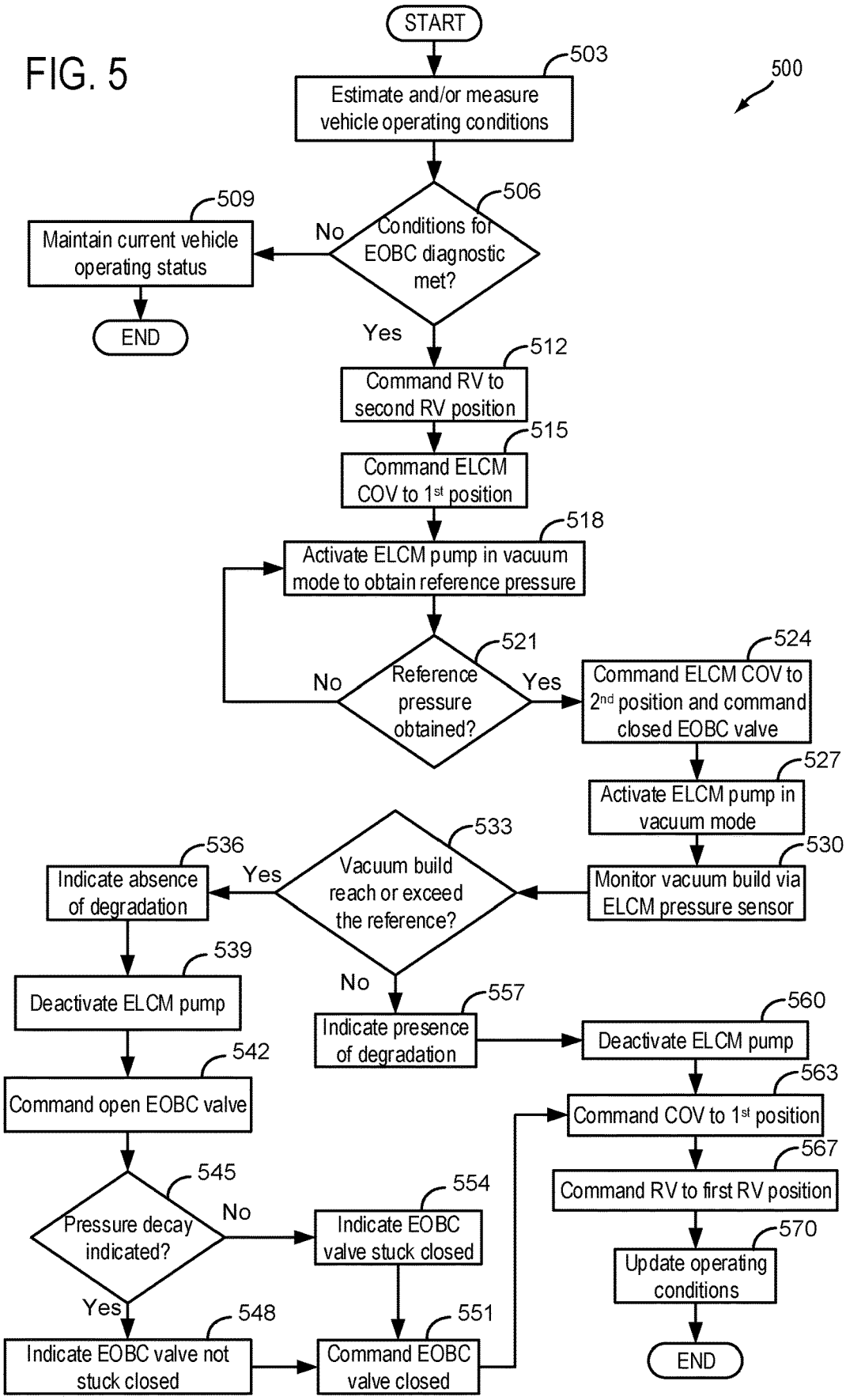
FIG. 5 depicts a high-level example method for conducting diagnostics on an engine-off boost conduit that routes pressurized air from the ELCM to the ejector system.
Figure 6:
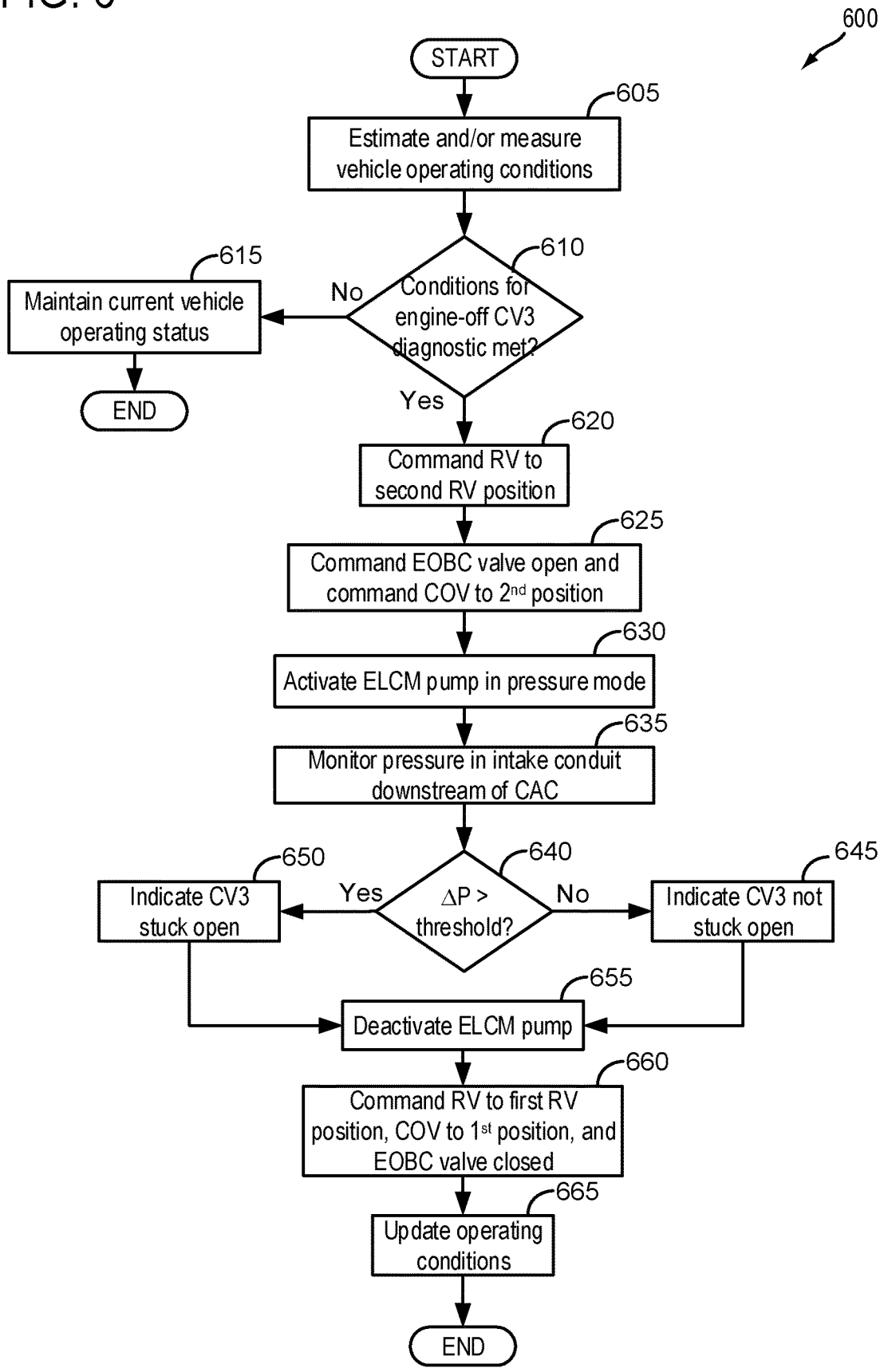
FIG. 6 depicts a high-level example method for diagnosing a third check valve configured to prevent positive pressure from entering into an intake passage of an engine from the engine-off boost conduit of FIG. 5.
Figure 7:
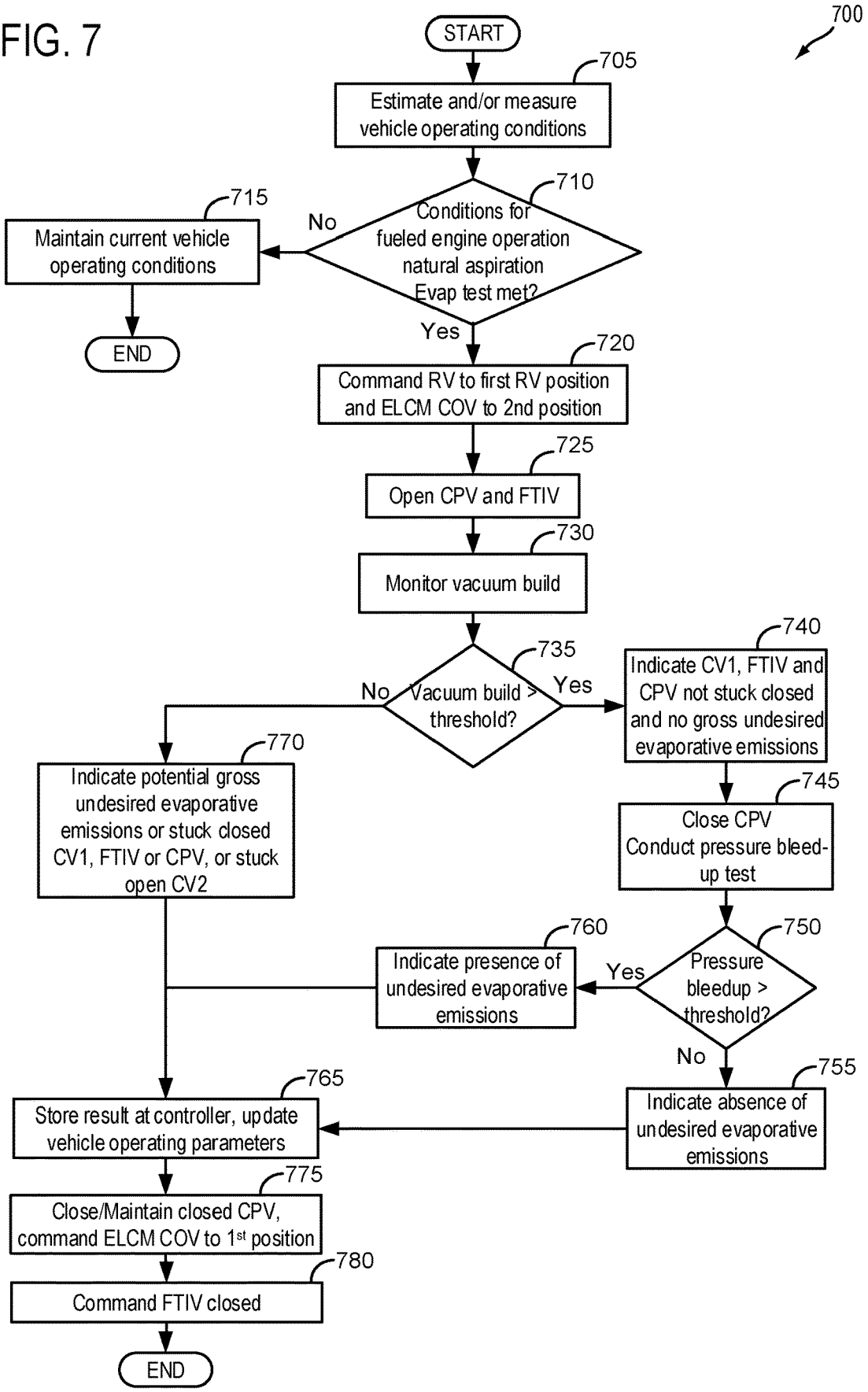
FIG. 7 depicts a high-level example method for conducting diagnostics on the fuel system and/or evaporative emissions system that relies on vacuum generated by an engine that is combusting air and fuel.
Figure 8:
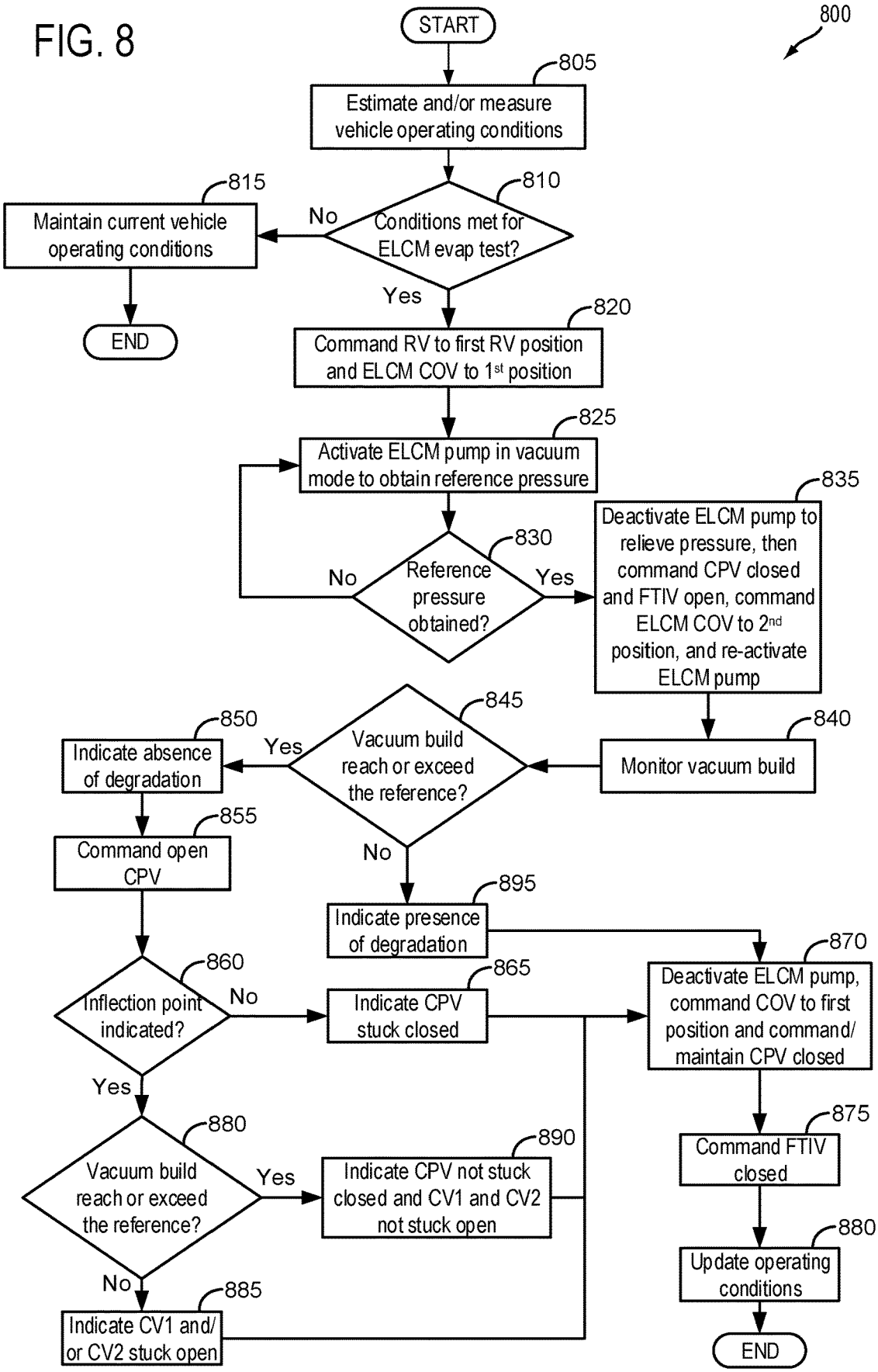
FIG. 8 depicts a high-level example method for using the ELCM to diagnose whether a canister purge valve is stuck closed, and whether a first check valve and/or a second check valve is stuck open.
Figure 11:
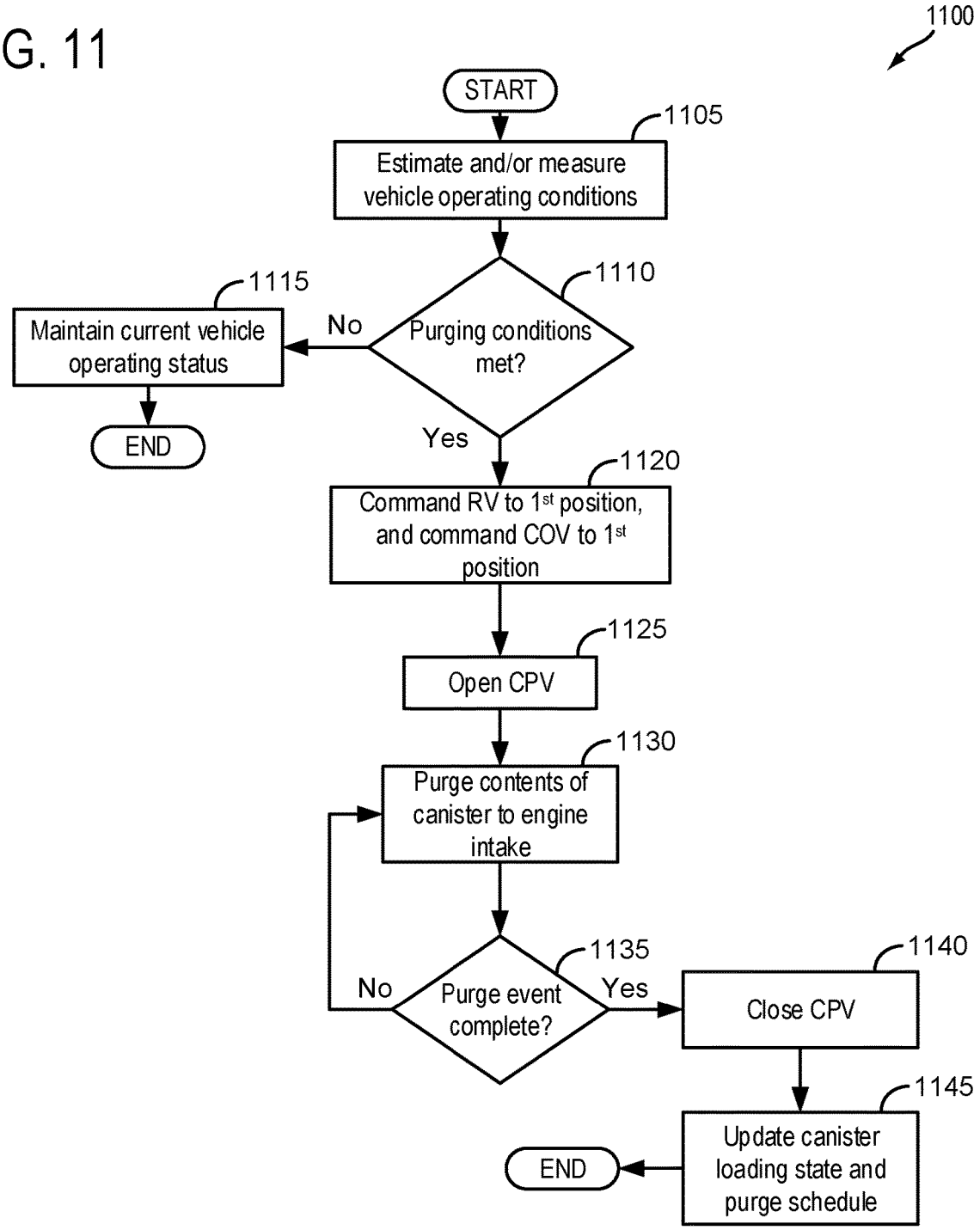
FIG. 11 depicts a high-level example method for conducting a purging operation of a fuel vapor storage canister that relies on engine intake manifold vacuum.

In order to use the ELCM pump to diagnose whether the ejector system is degraded during engine-off conditions, a number of conditions may have to first be met in order to pinpoint degradation as stemming from the ejector system and not from other aspects of the dual-path purge system. One such condition is that the EOBC (including an EOBC valve) is not degraded. Accordingly a diagnostic pertaining to whether or not the EOBC is degraded, is depicted at FIG. 5. Another such condition is that the third check valve (CV3) configured to prevent positive pressure with respect to atmospheric pressure from entering into the intake passage of the engine from the EOBC is not stuck open. Accordingly, methodology for determining whether the CV3 is stuck open is depicted at FIG. 6. Yet another such condition is that there is no indicated degradation stemming from the fuel system and/or evaporative emissions system and that a canister purge valve (CPV) and a fuel tank isolation valve (FTIV) are not stuck closed. Accordingly methodology for assessing such parameters is depicted at FIG. 7, where such methodology relies on intake manifold vacuum under conditions of engine operation. Still another condition for enabling entry into the ejector system diagnostic may include an indication that the first check valve (CV1) is not stuck open. Accordingly, FIG. 8 depicts methodology for assessing whether the CV1 is potentially stuck open, and further includes methodology for determining presence or absence of undesired evaporative emissions stemming from the fuel system and/or evaporative emissions system and whether the CPV (and in some examples the FTIV) is stuck closed. Yet another such condition may comprise an indication that the fuel vapor storage canister is substantially clean (e.g. 5% loaded or less), and accordingly a method for purging the canister that relies on engine intake manifold vacuum is depicted at FIG. 11.

Figure 9:
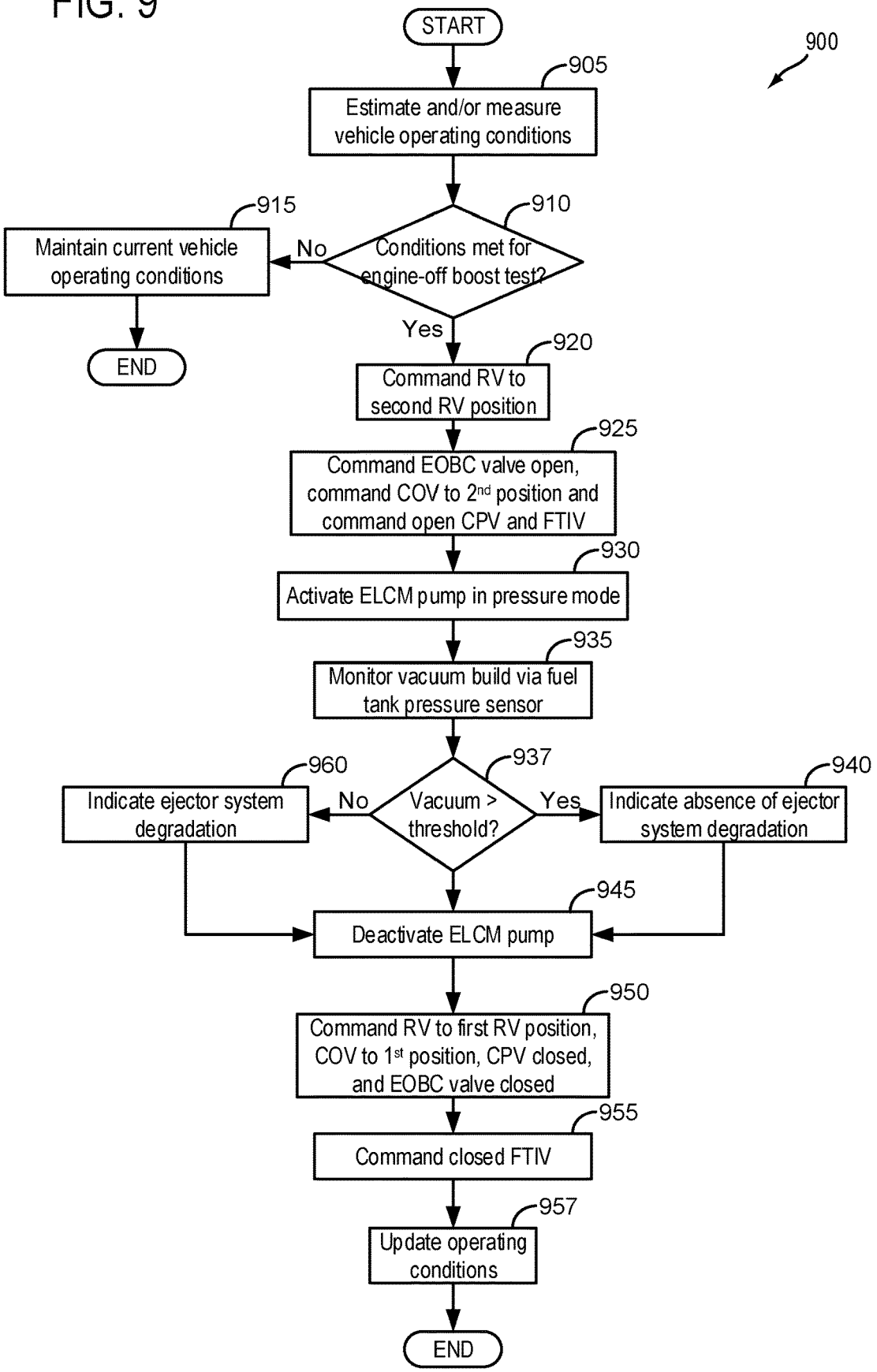
FIG. 9 depicts a high-level example method for conducting a diagnostic to assess functionality of an ejector system during engine-off conditions.
Figure 10:
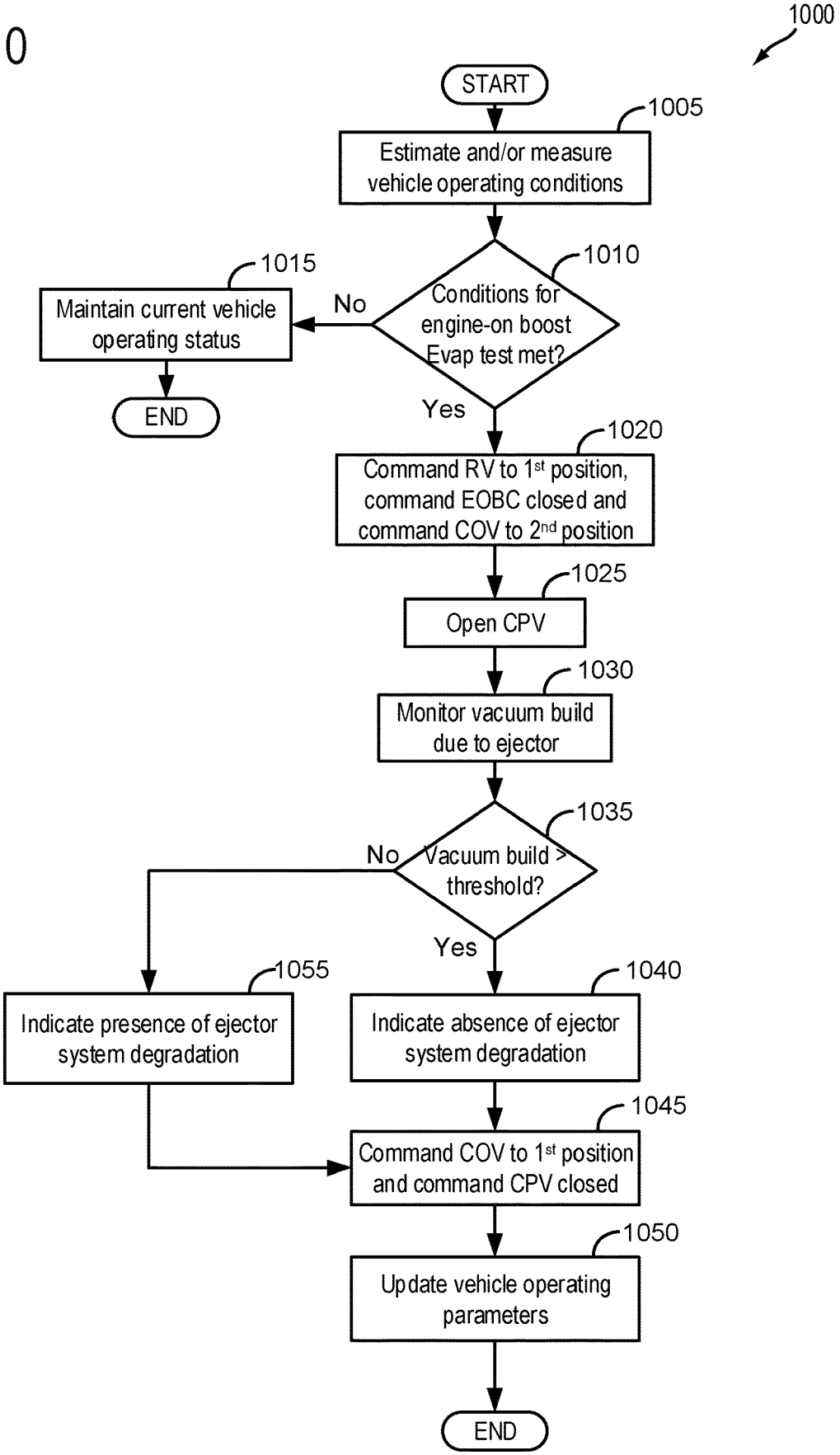
FIG. 10 depicts a high-level example method for conducting a diagnostic to assess functionality of an ejector system during conditions where the engine is combusting air and fuel.

Provided conditions are met for conducting the engine-off diagnostic to ascertain presence or absence of degradation stemming from the ejector system, the methodology of FIG. 9 may be used. However, it is also recognized that there may in some examples be opportunity to conduct a similar diagnostic that relies on boosted engine operation, and accordingly, such a method is depicted at FIG. 10.

Figure 12:
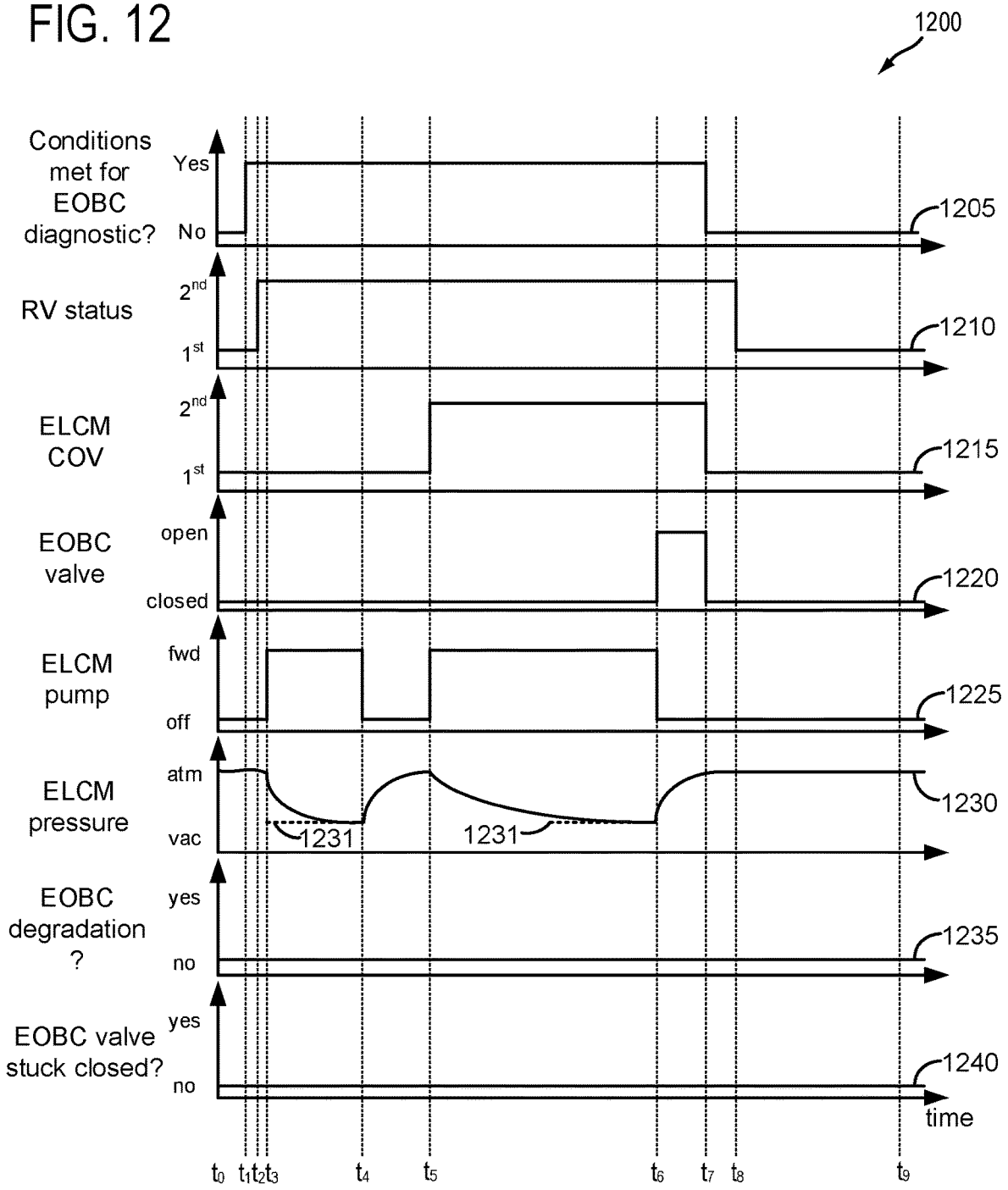
FIG. 12 depicts an example timeline for conducting the diagnostics on the engine-off boost conduit according to the method of FIG. 5.
Figure 13:
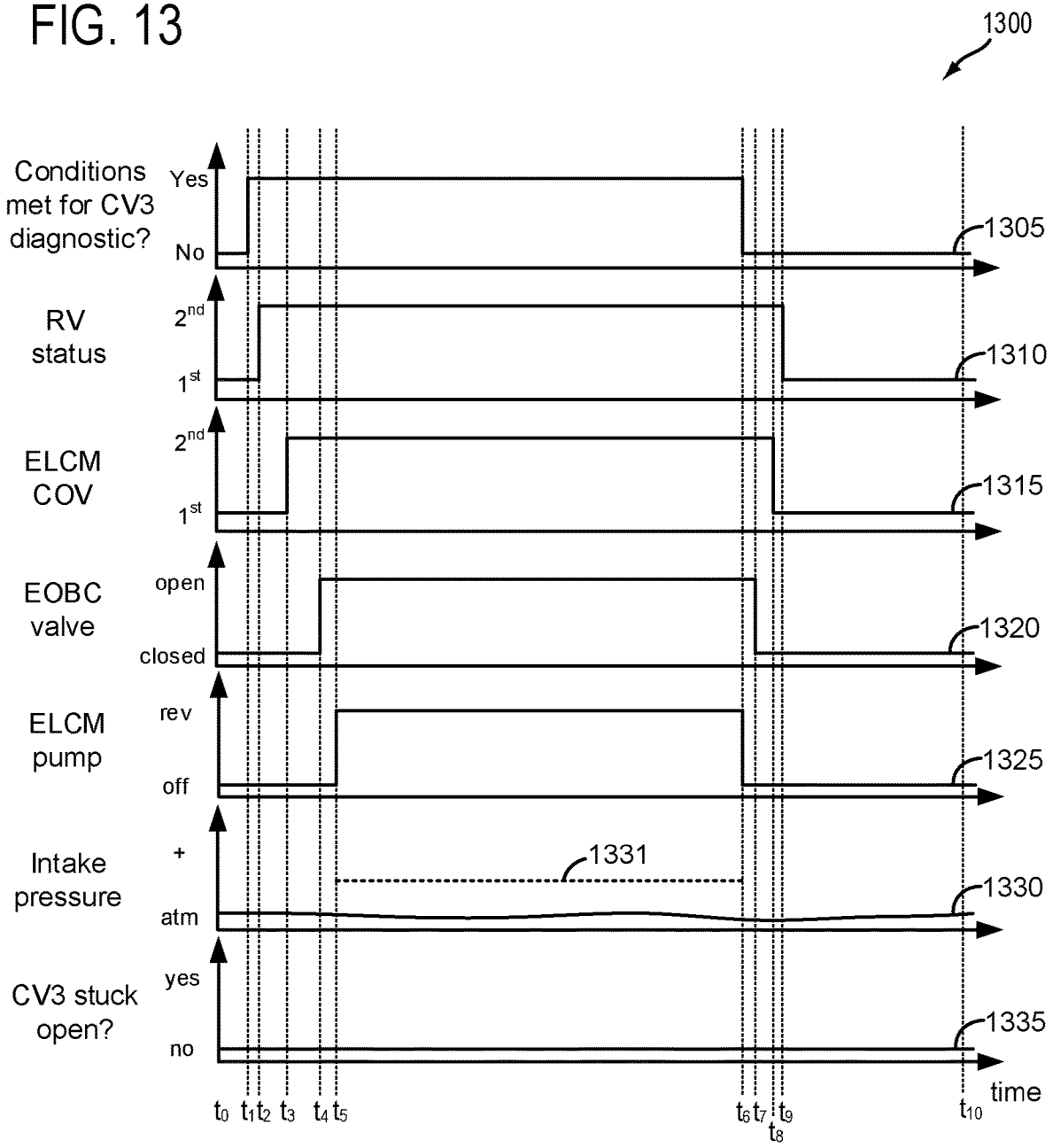
FIG. 13 depicts an example timeline for diagnosing the third check valve according to the method of FIG. 6.
Figure 14:
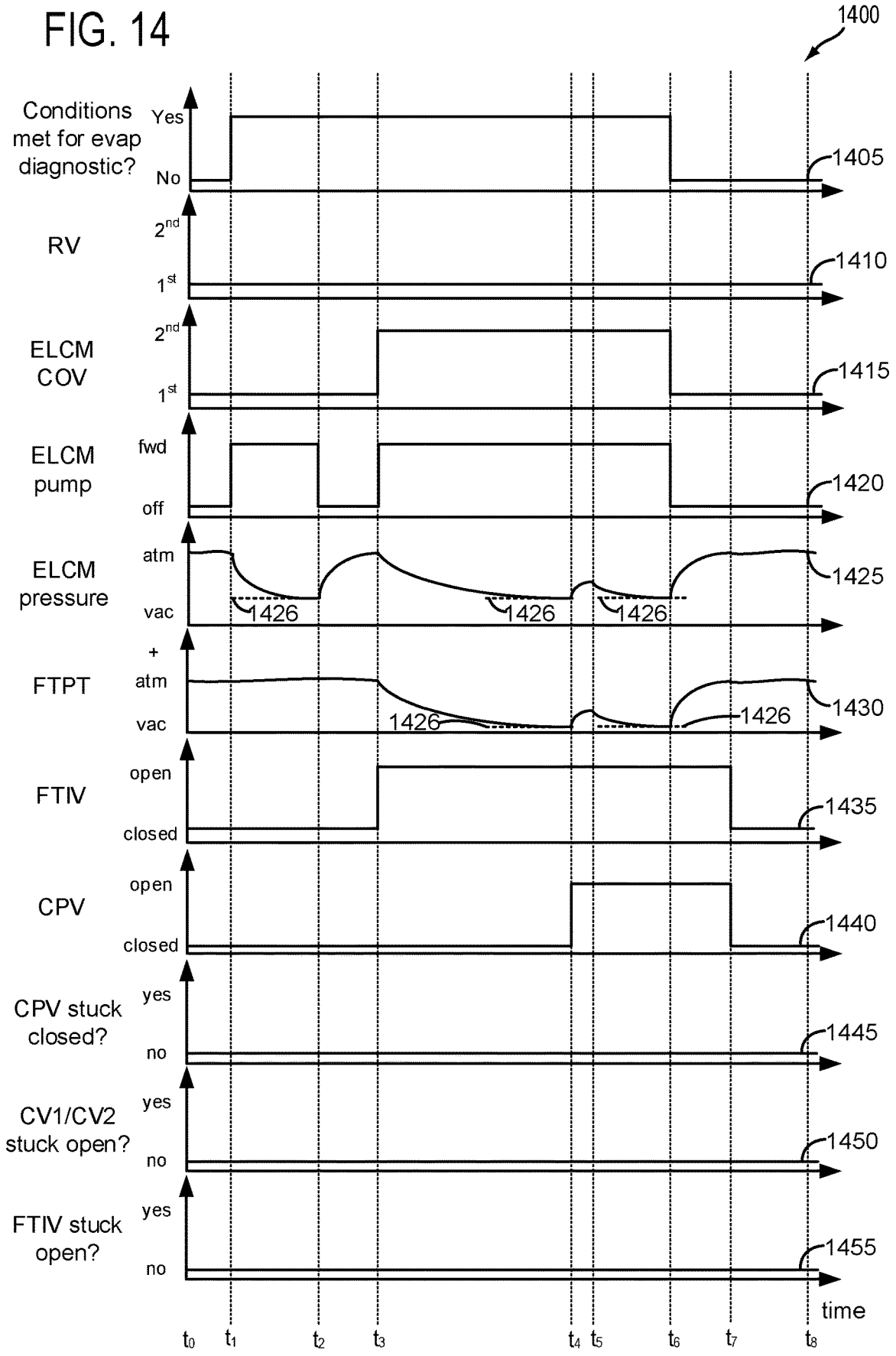
FIG. 14 depicts an example timeline for diagnosing whether the canister purge valve is stuck closed and whether the first check valve and/or second check valve is stuck open, according to the method of FIG. 8.
Figure 15:
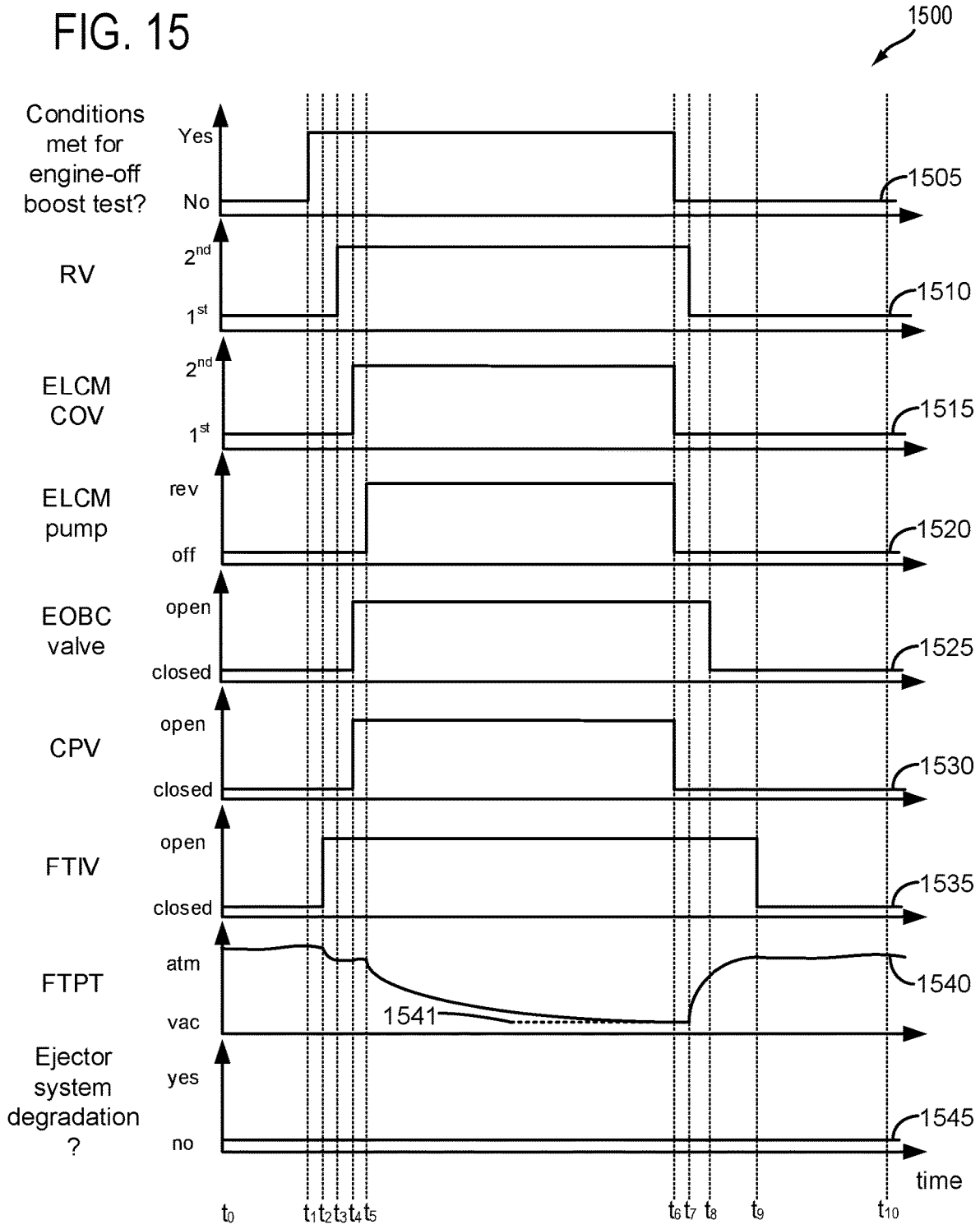
FIG. 15 depicts an example timeline for conducting the diagnostic to assess functionality of the ejector system during engine-off conditions, according to the method of FIG. 9.

FIG. 12 depicts an example timeline illustrating the methodology of FIG. 5, FIG. 13 depicts an example timeline illustrating the methodology of FIG. 6, FIG. 14 depicts an example timeline illustrating the methodology of FIG. 8, and FIG. 15 depicts an example timeline illustrating the methodology of FIG. 9.

Turning to the figures, FIG. 1 shows a schematic depiction of a vehicle system 100. The vehicle system 100 includes an engine system 102 coupled to a fuel vapor recovery system (evaporative emissions control system) 154 and a fuel system 106. The engine system 102 may include an engine 112 having a plurality of cylinders 108. In some examples, the vehicle system may be configured as a hybrid electric vehicle (HEV) or plug-in HEV (PHEV), with multiple sources of torque available to one or more vehicle wheels 198. In the example shown, vehicle system 100 may include an electric machine 195. Electric machine 195 may be a motor or a motor/generator. Crankshaft 199 of engine 112 and electric machine 195 are connected via a transmission 197 to vehicle wheels 198 when one or more clutches 194 are engaged. In the depicted example, a first clutch is provided between crankshaft 199 and electric machine 195, and a second clutch is provided between electric machine 195 and transmission 197. Controller 166 may send a signal to an actuator of each clutch 194 to engage or disengage the clutch, so as to connect or disconnect crankshaft 199 from electric machine 195 and the components connected thereto, and/or connect or disconnect electric machine 195 from transmission 197 and the components connected thereto. Transmission 197 may be a gearbox, a planetary gear system, or another type of transmission. The powertrain may be configured in various manners including as a parallel, a series, or a series-parallel hybrid vehicle.

Electric machine 195 receives electrical power from a traction battery 196 to provide torque to vehicle wheels 198. Electric machine 195 may also be operated as a generator to provide electrical power to charge traction battery 196, for example during a braking operation.

The engine 112 includes an engine intake 23 and an engine exhaust 25. The engine intake 23 includes a throttle 114 fluidly coupled to the engine intake manifold 116 via an intake passage 118. An air filter 174 is positioned upstream of throttle 114 in intake passage 118. The engine exhaust 25 includes an exhaust manifold 120 leading to an exhaust passage 122 that routes exhaust gas to the atmosphere. The engine exhaust 122 may include one or more emission control devices 124, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors, as further elaborated below.

Throttle 114 may be located in intake passage 118 downstream of a compressor 126 of a boosting device, such as turbocharger 50, or a supercharger. Compressor 126 of turbocharger 50 may be arranged between air filter 174 and throttle 114 in intake passage 118. Compressor 126 may be at least partially powered by exhaust turbine 54, arranged between exhaust manifold 120 and emission control device 124 in exhaust passage 122. Compressor 126 may be coupled to exhaust turbine 54 via shaft 56. Compressor 126 may be configured to draw in intake air at atmospheric air pressure into an air induction system (AIS) 173 and boost it to a higher pressure. Using the boosted intake air, a boosted engine operation may be performed.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine via a turbine bypass passage as controlled by wastegate (not shown). An amount of boost may additionally or optionally be controlled by controlling an amount of intake air directed through compressor 126. Controller 166 may adjust an amount of intake air that is drawn through compressor 126 by adjusting the position of a compressor bypass valve (not shown). In one example, when a larger amount of boost is requested, a smaller amount of intake air may be directed through the compressor bypass passage.

Fuel system 106 may include a fuel tank 128 coupled to a fuel pump system 130. The fuel pump system 130 may include one or more pumps for pressurizing fuel delivered to fuel injectors 132 of engine 112. While only a single fuel injector 132 is shown, additional injectors may be provided for each cylinder. For example, engine 112 may be a direct injection gasoline engine and additional injectors may be provided for each cylinder. It will be appreciated that fuel system 106 may be a return-less fuel system, a return fuel system, or various other types of fuel system. In some examples, a fuel pump may be configured to draw the tank's liquid from the tank bottom. Vapors generated in fuel system 106 may be routed to fuel vapor recovery system (evaporative emissions control system) 154, described further below, via conduit 134, before being purged to the engine intake 23. To isolate fuel system 106 from evaporative emissions system 154, a fuel tank isolation valve (FTIV) 181 may be included in conduit 134.

Fuel vapor recovery system 154 includes a fuel vapor retaining device or fuel vapor storage device, depicted herein as fuel vapor canister 104. Canister 104 may be filled with an adsorbent capable of binding large quantities of vaporized HCs. In one example, the adsorbent used is activated charcoal. Canister 104 may include a buffer **104*a* (or buffer region) and a non-buffer region 104*b*, each of the buffer 104*a* and the non-buffer region 104*b* comprising the adsorbent. The adsorbent in the buffer 104*a* may be the same as, or different from, the adsorbent in the non-buffer region 104*b*. As illustrated, the volume of buffer 104*a* may be smaller than (e.g. a fraction of) the volume of the non-buffer region 104*b*. Buffer 104*a* may be positioned within canister 104 such that during canister loading, fuel tank vapors are first adsorbed within the buffer, and then when the buffer is saturated, further fuel tank vapors are adsorbed in the non-buffer region 104*b* of canister 104. In comparison, during canister purging, fuel vapors may first be desorbed from the non-buffer region 104*b* (e.g., to a threshold amount) before being desorbed from the buffer 104*a***. In other words, loading and unloading of the buffer is not linear with the loading and unloading of the non-buffer region. As such, the effect of the canister buffer is to dampen any fuel vapor spikes flowing from the fuel tank to the canister, thereby reducing the possibility of any fuel vapor spikes going to the engine.

Canister 104 may receive fuel vapors from fuel tank 128 through conduit 134. While the depicted example shows a single canister, it will be appreciated that in alternate embodiments, a plurality of such canisters may be connected together. Canister 104 may communicate with the atmosphere through vent line 136. An evaporative level check monitor (ELCM) 182 may be disposed in vent line 136 and may be configured to control venting and/or assist in detection of undesired evaporative emissions. ELCM 182 may include an ELCM pressure sensor 183. Details of how ELCM 182 operates will be discussed in further detail below with regard to FIGS. 3A-4B.

In some examples, one or more oxygen sensors (not shown) may be positioned in the engine intake 116, or coupled to the canister 104 (e.g., downstream of the canister), to provide an estimate of canister load. In still further examples, one or more temperature sensors 157 may be coupled to and/or within canister 104. For example, as fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister, and may be used to estimate canister load.

FTIV 181 may allow the fuel vapor canister 104 to be maintained at a low pressure or vacuum without increasing the fuel evaporation rate from the tank (which would otherwise occur if the fuel tank pressure were lowered). The fuel tank 128 may hold a plurality of fuel blends, including fuel with a range of alcohol concentrations, such as various gasoline-ethanol blends, including E10, E85, gasoline, etc., and combinations thereof.

Fuel vapor recovery system 154 may include a dual path purge system 171. Purge system 171 is coupled to canister 104 via a conduit 150. Conduit 150 may include a canister purge valve (CPV) 158 disposed therein. CPV 158 may regulate the flow of vapors along duct 150. The quantity and rate of vapors released by CPV 158 may be determined by the duty cycle of an associated CPV solenoid (not shown). In one example, the duty cycle of the CPV solenoid may be determined by controller 166 responsive to engine operating conditions, including, for example, an air-fuel ratio. By commanding CPV 158 to be closed, the controller may seal the fuel vapor canister from the fuel vapor purging system, such that no vapors are purged via the fuel vapor purging system. In contrast, by commanding CPV 158 to be open, the controller may enable the fuel vapor purging system to purge vapors from the fuel vapor canister.

Fuel vapor canister 104 operates to store vaporized hydrocarbons (HCs) from fuel system 106. Under some operating conditions, such as during refueling, fuel vapors present in the fuel tank may be displaced when liquid is added to the tank. The displaced air and/or fuel vapors may be routed from the fuel tank 128 to the fuel vapor canister 104, and then to the atmosphere through vent line 136. In this way, vaporized HCs may be stored in fuel vapor canister 104.

During a later engine operation, the stored vapors may be released back into the incoming air charge via fuel vapor purging system 171.

In some examples, an air intake system hydrocarbon trap (AIS HC) 169 may be placed in the intake manifold of engine 112 to adsorb fuel vapors emanating from unburned fuel in the intake manifold, puddled fuel from leaky injectors and/or fuel vapors in crankcase ventilation emissions during engine-off periods. The AIS HC 169 may include a stack of consecutively layered polymeric sheets impregnated with HC vapor adsorption/desorption material. Alternately, the adsorption/desorption material may be filled in the area between the layers of polymeric sheets. The adsorption/desorption material may include one or more of carbon, activated carbon, zeolites, or any other HC adsorbing/desorbing materials. When the engine is operational causing an intake manifold vacuum and a resulting airflow across AIS HC 169, the trapped vapors may be passively desorbed from the AIS HC and combusted in the engine. Thus, during engine operation, intake fuel vapors are stored and desorbed from AIS HC 169. In addition, fuel vapors stored during an engine shutdown can also be desorbed from the AIS HC during engine operation. In this way, AIS HC 169 may be continually loaded and purged, and the trap may reduce evaporative emissions from the intake passage even when engine 112 is shut down.

Conduit 150 is coupled to an ejector 140 in an ejector system 141 and includes a second check valve (CV2) 170 disposed therein between ejector 140 and CPV 158. CV2 170 may prevent intake air from flowing through from the ejector into conduit 150, while allowing flow of air and fuel vapors from conduit 150 into ejector 140. CV2 170 may be a vacuum-actuated check valve, for example, that opens responsive to vacuum derived from ejector 140.

A conduit 151 couples conduit 150 to intake 23 at a position within conduit 150 between CV2 170 and CPV 158 and at a position in intake 23 downstream of throttle 114. For example, conduit 151 may be used to direct fuel vapors from canister 104 to intake 23 using vacuum generated in intake manifold 116 during a purge event. Conduit 151 may include a first check valve (CV1) 153 disposed therein. CV1 153 may prevent intake air from flowing through from intake manifold 116 into conduit 150, while allowing flow of fluid and fuel vapors from conduit 150 into intake manifold 116 via conduit 151 during a canister purging event. CV1 153 may be a vacuum-actuated check valve, for example, that opens responsive to vacuum derived from intake manifold 116.

Conduit 148 may be coupled to ejector 140 at a first port or inlet 142. Conduit 148 may include a third check valve (CV3) 184. CV3 184 may open in response to a positive pressure with respect to atmospheric pressure greater than a CV3 opening threshold, the positive pressure in intake conduit 118. For example, during boost conditions where compressor 126 is activated, CV3 184 may open to direct boosted air to ejector system 141. Alternatively, as will be elaborated further below, CV3 184 may prevent the flow of positive pressure with respect to atmospheric pressure from flowing the other direction through CV3 184, specifically from conduit 148 through CV3 184 to intake conduit 118. Thus, it may be understood that CV3 184 comprises a pressure/vacuum-actuated valve, that opens responsive to boosted air in intake conduit 118 to allow positive pressure with respect to atmospheric pressure to enter into ejector system 141, but which prevents positive pressure from traversing CV3 in the reverse direction (e.g. to intake conduit 118). Accordingly, during boost conditions, conduit 148 may direct compressed air in intake conduit 118 downstream of compressor 126 into ejector 140 via port 142.

Ejector 140 may also be coupled to intake conduit 118 at a position upstream of compressor 126 via a shut-off valve 193. Shut-off valve 193 is hard-mounted directly to air induction system 173 along conduit 118 at a position between air filter 174 and compressor 126. For example, shut-off valve 193 may be coupled to an existing AIS nipple or other orifice, e.g., an existing SAE male quick connect port, in AIS 173. Hard-mounting may include a direct mounting that is inflexible. For example, an inflexible hard mount could be accomplished through a multitude of methods including spin welding, laser bonding, or adhesive. Shut-off valve 193 is configured to close in response to undesired emissions detected downstream of outlet 146 of ejector 140. As shown in FIG. 1, in some examples, a conduit or hose 152 may couple the third port 146 or outlet of ejector 140 to shut-off valve 193. In this example, if a disconnection of shut-off valve 193 with AIS 173 is detected, then shut-off valve 193 may close so air flow from the engine intake downstream of the compressor through the converging orifice in the ejector is discontinued. However, in other examples, shut-off valve may be integrated with ejector 140 and directly coupled thereto.

Ejector 140 includes a housing 168 coupled to ports 146, 144, and 142. In one example, only the three ports 146, 144, and 142 are included in ejector 140. Ejector 140 may include various check valves disposed therein. For example, ejector 140 may include a check valve positioned adjacent to each port in ejector 140 so that unidirectional flow of fluid or air is present at each port. For example, air from intake conduit 118 downstream of compressor 126 may be directed into ejector 140 via inlet port 142 and may flow through the ejector and exit the ejector at outlet port 146 before being directed into intake conduit 118 at a position upstream of compressor 126. This flow of air through the ejector may create a vacuum due to the Venturi effect at inlet port 144 so that vacuum is provided to conduit 150 via port 144 during boosted operating conditions. In particular, a low pressure region is created adjacent to inlet port 144 which may be used to draw purge vapors from the canister into ejector 140, when CPV 158 is additionally commanded open.

Ejector 140 includes a nozzle 191 comprising an orifice which converges in a direction from inlet 142 toward suction inlet 144 so that when air flows through ejector 140 in a direction from port 142 towards port 146, a vacuum is created at port 144 due to the Venturi effect. This vacuum may be used to assist in fuel vapor purging during certain conditions, e.g., during boosted engine conditions. In one example, ejector 140 is a passive component. That is, ejector 140 is designed to provide vacuum to the fuel vapor purge system via conduit 150 to assist in purging under various conditions, without being actively controlled. Thus, whereas CPV 158, and throttle 114 may be controlled via controller 166, for example, ejector 140 may be neither controlled via controller 166 nor subject to any other active control. In another example, the ejector may be actively controlled with a variable geometry to adjust an amount of vacuum provided by the ejector to the fuel vapor recovery system via conduit 150.

During select engine and/or vehicle operating conditions, such as after an emission control device light-off temperature has been attained (e.g., a threshold temperature reached after warming up from ambient temperature) and with the engine running, the controller 166 may command a change-over valve (not shown at FIG. 1 but see FIGS. 3A-3D) associated with ELCM 182 to fluidically couple canister 104 to atmosphere via vent line 136, and may further adjust the duty cycle of the CPV solenoid (not shown) and control opening of CPV 158. Pressures within fuel vapor purging system 171 may then draw fresh air through vent line 136, fuel vapor canister 104, and CPV 158 such that fuel vapors flow, or in other words, are purged into conduit 150 from canister 104.

During intake manifold vacuum conditions which may be present, as one example, during an engine idle condition, where manifold pressure is below atmospheric pressure by a threshold amount, the vacuum in the intake system 23 may draw fuel vapor from the canister through conduits 150 and 151 into intake manifold 116. In such an example, vacuum may be prevented from being drawn on ejector system via CV2 170 and CV3 184.

The operation of ejector 140 within fuel vapor purging system 171 during boost conditions will next be described. The boost conditions may include conditions during which the mechanical compressor (e.g. 126) is in operation. For example, the boost conditions may include one or more of a high engine load condition and a super-atmospheric intake condition, with intake manifold pressure greater than atmospheric pressure by a threshold amount.

Fresh air enters intake passage 118 at air filter 174. During boost conditions, compressor 126 pressurizes the air in intake passage 118, such that intake manifold pressure is positive with respect to atmospheric pressure. Pressure in intake passage 118 upstream of compressor 126 is lower than intake manifold pressure during operation of compressor 126, and this pressure differential induces a flow of fluid from intake conduit 118 through duct 148 and into ejector 140 via ejector inlet 142. This fluid may include a mixture of air and fuel, in some examples. After the fluid flows into the ejector via the port 142, it flows through the converging orifice 192 in nozzle 191 in a direction from port 142 towards outlet 146. Because the diameter of the nozzle gradually decreases in a direction of this flow, a low pressure zone is created in a region of orifice 192 adjacent to suction inlet 144. The pressure in this low pressure zone may be lower than a pressure in duct 150. When present, this pressure differential provides a vacuum to conduit 150 to draw fuel vapor from canister 104. This pressure differential may induce flow of fuel vapors from the fuel vapor canister, through CPV 158 (where the CPV is commanded open), and into port 144 of ejector 140. Upon entering the ejector, the fuel vapors may be drawn along with the fluid from the intake manifold out of the ejector via outlet port 146 and into intake 118 at a position upstream of compressor 126. Operation of compressor 126 then draws the fluid and fuel vapors from ejector 140 into intake passage 118 and through the compressor 126. After being compressed by compressor 126, the fluid and fuel vapors flow through charge air cooler 156, for delivery to intake manifold 116 via throttle 114 It may be understood that the above-described operation of ejector 140 during boost conditions relates to an engine-on condition, where the vehicle is in operation and the engine is combusting air and fuel. However, there may be other opportunities for providing pressurized air to ejector system 141, with the engine off. Such examples will be described in detail below.

Vehicle system 100 may further include a control system 160. Control system 160 is shown receiving information from a plurality of sensors 162 (various examples of which are described herein) and sending control signals to a plurality of actuators 164 (various examples of which are described herein). As one example, sensors 162 may include an exhaust gas sensor 125 (located in exhaust manifold 120) and various temperature and/or pressure sensors arranged in intake system 23. For example, a pressure or airflow sensor 115 in intake conduit 118 downstream of throttle 114, a pressure or air flow sensor 117 in intake conduit 118 between compressor 126 and throttle 114, and/or a pressure or air flow sensor 119 in intake conduit 118 upstream of compressor 126. In some examples, pressure sensor 119 may comprise a dedicated barometric pressure sensor. Other sensors such as additional pressure, temperature, air/fuel ratio, and composition sensors may be coupled to various locations in the vehicle system 100. As another example, actuators 164 may include fuel injectors 132, throttle 114, compressor 126, a fuel pump of pump system 130, etc. The control system 160 may include an electronic controller 166. The controller may receive input data from the various sensors, process the input data, and trigger the actuators in response to the processed input data based on instruction or code programmed therein corresponding to one or more routines.

In some examples, the controller may be placed in a reduced power mode or sleep mode, wherein the controller maintains essential functions only, and operates with lower battery consumption than in a corresponding awake mode. For example, the controller may be placed in a sleep mode following a vehicle-off event in order to perform a diagnostic routine at a duration following the vehicle-off event. The controller may have a wake input that allows the controller to be returned to an awake mode based on an input received from one or more sensors. In some examples, the controller may schedule a wake-up time, which may comprise setting a timer and when the timer elapses, the controller may be woken up from sleep mode.

Diagnostic tests may be periodically performed on the evaporative emissions control system 154 and fuel system 106 in order to indicate the presence or absence of undesired evaporative emissions and/or to diagnose functionality of one or more of check valves (e.g. CV1, CV2, CV3) CPV, ejector system, etc. As one example, under natural aspiration conditions (e.g. intake manifold vacuum conditions) where the engine 112 is being operated to combust air and fuel, the ELCM changeover valve (discussed in further detail at FIGS. 3A-3D) may be commanded such that vent line 136 is sealed from atmosphere, and CPV 158 may be commanded open. FTIV 181 may additionally be commanded open, such that pressure in the evaporative emissions system and fuel system may be monitored via fuel tank pressure transducer (FTPT) 107. However, in other examples FTIV 181 may be maintained closed, where pressure in the evaporative emissions system may be monitored via pressure sensor 183 associated with ELCM 182. In this way, during natural aspiration conditions where the engine is in operation, the evaporative emissions control system 154 (and in examples where FTIV 181 is also commanded open, fuel system 106) may be evacuated. If a threshold vacuum (e.g. negative pressure threshold with respect to atmospheric pressure) is reached during evacuating the evaporative emissions control system 154 (and fuel system 106 in a case where FTIV 181 is commanded open), an absence of gross (e.g. a source of undesired evaporative emissions greater than 0.09") undesired evaporative emissions may be indicated. Furthermore, if the threshold vacuum is reached, then it may be indicated that the first check valve (CV1) 153 is not stuck closed or substantially closed, and that CPV 158 opened as commanded. Responsive to the threshold vacuum being reached, CPV 158 may be commanded closed and pressure in evaporative emissions system (and in some examples fuel system as well) may be monitored. A pressure rise (e.g. bleed-up) greater than a predetermined pressure rise threshold, or a pressure rise rate (e.g. bleed-up rate) rate greater than a predetermined pressure rise rate threshold may indicate the presence of non-gross (e.g. 0.02", or 0.04") undesired evaporative emissions.

Another example describes a diagnostic test for the presence or absence of undesired evaporative emissions stemming from the fuel system and/or evaporative emissions system, under boost conditions, where the engine is operating to combust air and fuel. Similar to that discussed above, in such an example the changeover valve associated with ELCM 182 may be commanded to seal vent line 136 from atmosphere, and CPV 158 may be commanded open. In some examples, FTIV 181 may additionally be commanded open, whereas in other examples FTIV 181 may be commanded or maintained closed. In this way, during boost conditions where the engine is operating to combust air and fuel, the evaporative emissions control system 154 (and in some examples fuel system 106 as well) may be evacuated via vacuum stemming from ejector system 141 as discussed above, in order to ascertain the presence or absence of undesired evaporative emissions.

In such an example, one or more of FTPT 107 and/or ELCM pressure sensor 183, depending on whether or not FTIV 181 was commanded open, may be used to monitor pressure in the fuel system and/or evaporative emissions system. If the threshold vacuum (e.g. negative pressure threshold with respect to atmospheric pressure) is reached during evacuating the fuel system and/or evaporative emissions control system, an absence of gross undesired evaporative emissions may be indicated. Responsive to the threshold vacuum being reached, CPV 158 may be commanded closed, and pressure bleedup monitored as discussed above to ascertain presence or absence of non-gross undesired evaporative emissions.

Furthermore, in such an example, if the threshold vacuum is reached under boosted engine operation, then it may be indicated that the second check valve (CV2) 170 is not stuck closed or substantially closed, and that the ejector system is functioning as desired or expected.

However, conducting such a diagnostic under boost conditions may not always be feasible for particular drive cycles, as certain drive cycles may not include boost conditions of sufficient duration to conduct such a diagnostic. As one example, in a case where it is desired to use boosted engine operation to evacuate the evaporative emissions system and the fuel system, depending on fuel tank size and fuel level, it may take as much as 15-20 seconds to evacuate the evaporative emissions system and fuel system to the threshold vacuum. However, boost duration may be as low as 1-3 seconds, thus preventing the ability to conduct the diagnostic.

To address such an issue, an engine-off boost conduit, referred to herein as EOBC 185 may be included in vehicle system 100, along with routing valve (RV) 186. RV 186 may be under control of controller 166, and may include a solenoid actuator 187. When solenoid actuator 187 is off, in other words when current is not supplied to solenoid actuator 187 under control of controller 166, it may be understood that RV 186 is in a first RV position, as depicted at FIG. 1. When RV 186 is configured in the first RV position, as depicted at FIG. 1, canister 104 may be fluidically coupled to ELCM 182 along vent line 136. Furthermore, EOBC 185 may be sealed from atmosphere when RV 186 is configured in the first RV position as depicted at FIG. 1. Alternatively, turning to FIG. 2, the same vehicle system 100 is depicted, with RV 186 configured in a second RV position. Specifically, it may be understood that when solenoid actuator 187 is commanded on, or in other words when controller 166 commands current to be supplied to solenoid actuator 187, RV 186 may adopt the second RV position as depicted at FIG. 2. When RV 186 is commanded to the second RV position, EOBC 185 may be fluidically coupled to ELCM 182 along vent line 136, whereas canister 104 may be sealed from atmosphere along vent line 136 as depicted at FIG. 2.

In this way, depending on the position of RV 186, ELCM 182 may be selectively fluidically coupled to canister 104, or to EOBC 185. Accordingly, this may in turn allow for relying on ELCM 182 to, when RV 186 is commanded to the first RV position as depicted at FIG. 1, evacuate the fuel system and/or evaporative emissions system to conduct certain diagnostics, and to alternatively conduct other diagnostics when RV 186 is commanded to the second RV position as depicted at FIG. 2.

Specifically, as will be elaborated further below, diagnostics for presence or absence of undesired evaporative emissions stemming from the evaporative emissions system and/or fuel system may be conducted via evacuating the fuel system and/or evaporative emissions system via ELCM 182 with CPV 158 commanded closed and RV 186 commanded to the first RV position as depicted at FIG. 1. Responsive to a threshold vacuum being reached, an absence of gross undesired evaporative emissions may be indicated, ELCM 182 may be commanded off, and the ELCM changeover valve (not shown at FIG. 1 but refer to FIGS. 3A-3D) may be controlled to seal vent line 136 from atmosphere. Then, similar to that discussed above pressure bleedup may be monitored in the sealed fuel system and/or evaporative emissions system to indicate presence or absence of non-gross undesired evaporative emissions.

Alternatively, with RV 186 commanded to the second RV position as depicted at FIG. 2, ELCM 182 may be used to direct pressurized air into EOBC 185 and into conduit 148. Thus, it may be understood that EOBC 185 may be coupled to conduit 148. In some examples, EOBC valve 189 may be included in EOBC 185, and may include a solenoid actuator (not shown) which may allow for controller 166 to command EOBC valve 189 to an open or closed position. Alternatively, in another example EOBC valve 189 may comprise a pressure/vacuum-actuated check valve, which may open responsive to pressurized air being communicated through EOBC 185 via ELCM 182 operating in a pressure-mode to supply pressurized air to ejector system 141 via EOBC 185, but which may close responsive to pressurized air being introduced into conduit 148 from intake passage 118.

Accordingly, it may be understood that, with RV 186 commanded to the second RV position as depicted at FIG. 2, pressurized air may be supplied to ejector system 141 via ELCM 182 operating in the pressure mode. In this way, an engine-off boost test diagnostic may be conducted, that does not rely on engine operation in order to introduce positive pressure to ejector system 141. Because, as discussed above, boost conditions that are derived from engine operation may not be sufficient for conducting diagnostics that rely on positive pressure being introduced to ejector system 141 due to infrequent and/or short engine-on boost duration, providing vehicle system 100 with an alternative means (ability to introduce positive pressure to ejector system 141 via operating ELCM 182 in pressure-mode) may improve ability to conduct diagnostics that rely on positive pressure being introduced to ejector system 141. Specifically, as will be elaborated below, in a situation where it is determined via the controller that the evaporative emissions system is free from the presence of undesired evaporative emissions and that the CPV is functioning as desired, pressure introduced to ejector system 141 via the ELCM operating in pressure-mode may be used to ascertain whether one or more of the ejector and/or CV2 170 are functioning as desired or expected, or are degraded to some extent.

As discussed above, ELCM 182 may include a change-over valve (COV). Accordingly, turning to FIGS. 3A-3D, they schematically depict examples of ELCM 182 control, including control over the COV, in various conditions in accordance with the present disclosure. As discussed with regard to FIGS. 1-2, when RV 186 is commanded to the first RV position, ELCM 182 may be fluidically coupled to canister 104. Alternatively, when RV 186 is commanded to the second RV position, ELCM 182 may be fludically coupled to EOBC 185. For simplicity with regard to FIGS. 3A-3D, operation of ELCM will be discussed in terms of ELCM 182 being fluidically coupled to the canister 104 as oposed to the EOBC 185. However, it may be understood that ELCM 182 may be controlled in similar fashion as that discussed below, under circumstances where ELCM 182 is fludically coupled to EOBC 185.

Figure 3B:
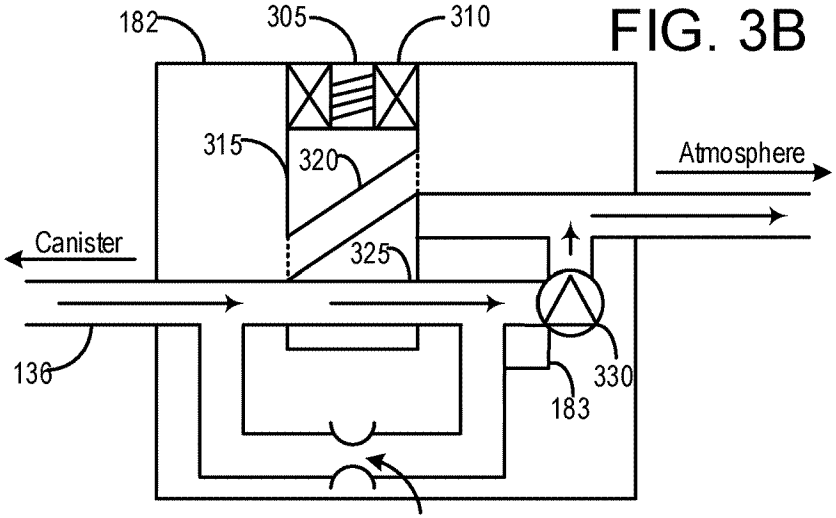
FIG. 3B shows a schematic depiction of an ELCM in a configuration to evacuate a fuel system and evaporative emissions system.
Figure 3A:
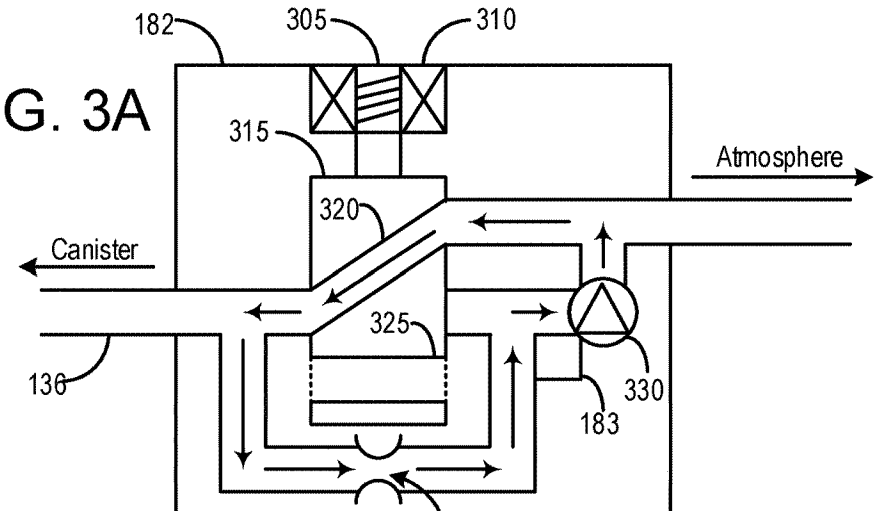
FIG. 3A shows a schematic depiction of an evaporative level check module (ELCM) in a configuration to perform a reference check.
Figure 3D:
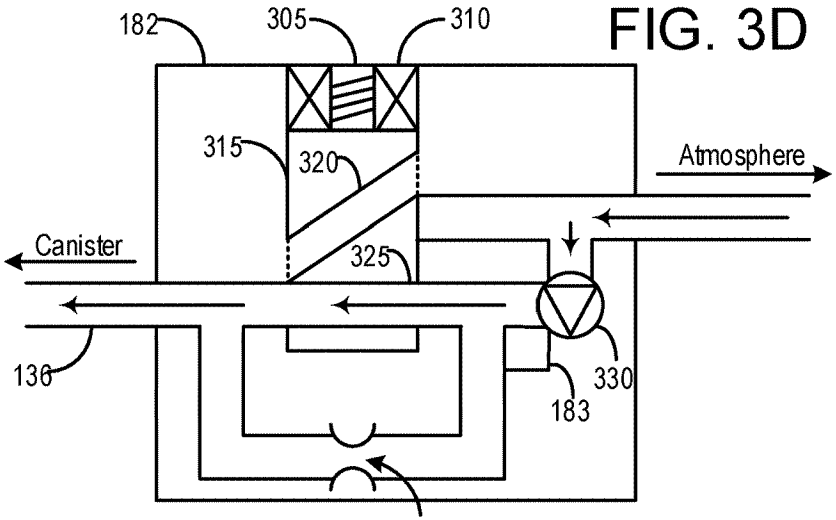
FIG. 3D shows a schematic depiction of an ELCM in a configuration to pressurize a fuel system and evaporative emissions system.
Figure 3C:
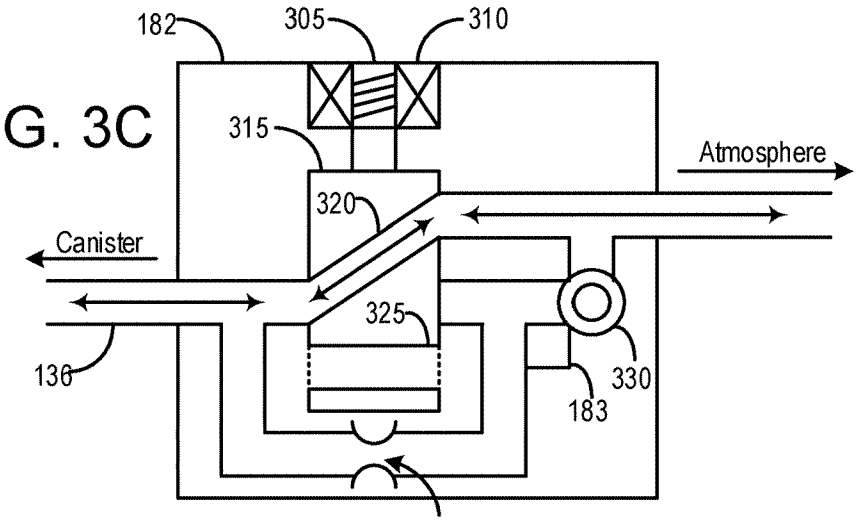
FIG. 3C shows a schematic depiction of an ELCM in a configuration that couples a fuel vapor canister to atmosphere.
Figure 4A:
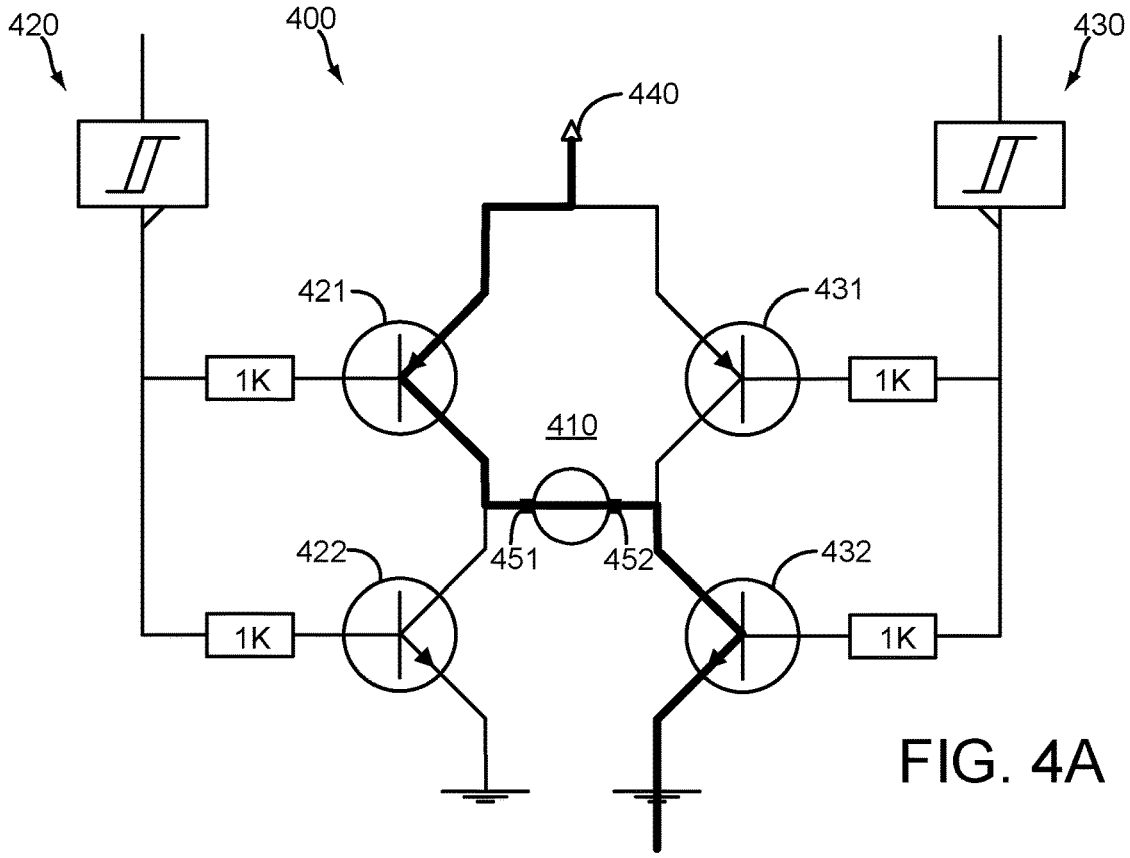
FIGS. 4A-4B show a schematic depiction of an electronic circuit configured to reverse the spin orientation of an electric motor.
Figure 4B:
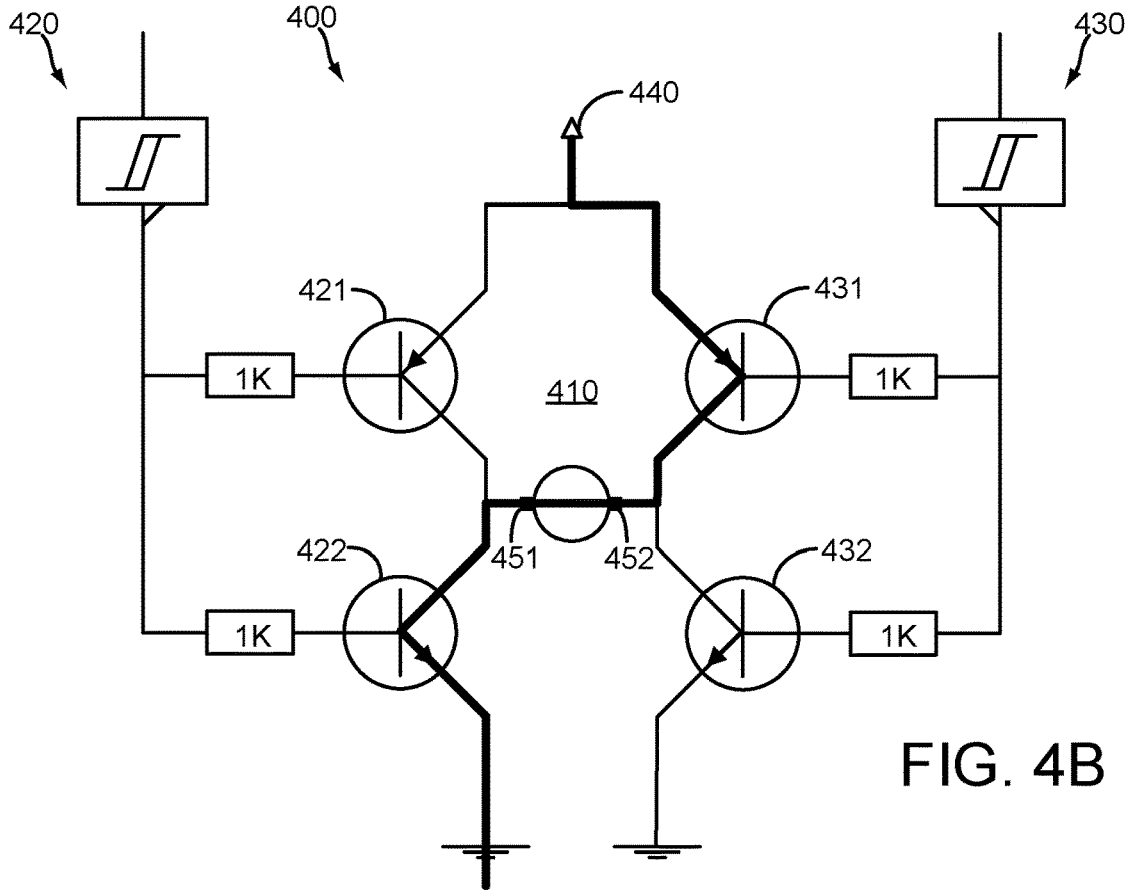

Turning to FIGS. 3A-3D, ELCM 182 includes change-over valve (COV) 315, a pump 330, and pressure sensor 183. Pump 330 may be a reversible pump, for example, a vane pump. COV 315 may be moveable between a first COV position a second COV position. In the first COV position, as shown in FIGS. 3A and 3C, air may flow through ELCM 182 via first flow path 320. In the second COV position, as shown in FIGS. 3B and 3D, air may flow through ELCM 182 via second flow path 325. The position of COV 315 may be controlled by solenoid 310 via compression spring 305. ELCM 182 may also comprise reference orifice 340. Reference orifice 340 may have a diameter corresponding to the size of a threshold for non-gross undesired evaporative emissions to be tested, for example, 0.02". In either the first or second COV position, pressure sensor 183 may generate a pressure signal reflecting the pressure within ELCM 182. Operation of pump 330 and solenoid 310 may be controlled via signals received from controller 166.

As shown in FIG. 3A, COV 315 is in the first COV position, and pump 330 is activated in a first direction, otherwise referred to as a vacuum-mode of operation. Air flow through ELCM 182 in this configuration is represented by arrows. In this configuration, pump 330 may draw a vacuum on reference orifice 340, and pressure sensor 183 may record the vacuum level within ELCM 182. This reference check vacuum level reading may then become the threshold for the presence or absence of undesired evaporative emissions in a subsequent evaporative emissions test diagnostic.

As shown in FIG. 3B, COV 315 is in the second COV position, and pump 330 is activated in the first direction. This configuration allows pump 330 to draw a vacuum on the fuel system and/or evaporative emissions system. Air flow through ELCM 182 in this configuration is represented by arrows. As discussed above, FIG. 3B relates to a situation where RV 186 is commanded to the first RV position. If instead RV 186 were commanded to the second RV position, then rather than drawing a vacuum on the fuel system and/or evaporative emissions system, the vacuum may be applied on the EOBC 185.

As shown in FIG. 3C, COV 315 is in the first COV position, and pump 330 is de-activated. This configuration allows for air to freely flow between atmosphere and the canister. This configuration may be used during a canister purging operation, for example, and may additionally be used during vehicle operation when a purging operation is not being conducted, and when the vehicle is not in operation.

As shown in FIG. 3D, COV 315 is in the second COV position, and pump 330 is activated in a second direction, otherwise referred to as a pressure-mode of operation, the second direction opposite from the first direction. In this configuration, pump 330 may pull air from atmosphere into the fuel system and/or evaporative emission system. As discussed above, FIG. 3D relates to a situation where RV 186 is commanded to the first RV position. If instead RV 186 were commanded to the second RV position, then rather than applying a positive pressure on the fuel system and/or evaporative emissions system, the positive pressure would be directed through EOBC 185.

As depicted at FIG. 3C, with pump 330 off and COV 315 configured in the first COV position, air flows freely between the canister and atmosphere when RV 186 is configured in the first RV position. Similarly, if RV 186 were configured in the second RV position, the air would flow freely between atmosphere and EOBC 185. While not explicitly illustrated, it may be understood that to simply seal either the canister from atmosphere (when RV 186 is commanded to the first RV position), or to seal the EOBC from atmosphere (when RV 186 is commanded to the second RV position), COV 315 may be configured in the second COV position, with pump 330 off.

As discussed, pump 330 may be operated in the pressure-mode or the vacuum-mode. Accordingly, turning to FIGS. 4A-4B, they depict an example circuit 400 that may be used for reversing a pump motor of ELCM 182. Circuit 400 schematically depicts an H-Bridge circuit that may be used to run a motor 410 in a first (forward) direction (e.g. vacuum-mode) and alternately in a second (reverse) direction (e.g. pressure-mode). Circuit 400 comprises a first (LO) side 420 and a second (HI) side 430. Side 420 includes transistors 421 and 422, while side 430 includes transistors 431 and 432. Circuit 400 further includes a power source 440.

In FIG. 4A, transistors 421 and 432 are activated, while transistors 422 and 431 are off. In this confirmation, the left lead 451 of motor 410 is connected to power source 440, and the right lead 452 of motor 410 is connected to ground. In this way, motor 400 may run in a forward direction.

In FIG. 4B, transistors 422 and 431 are activated, while transistors 421 and 432 are off. In this confirmation, the right lead 452 of motor 410 is connected to power source 440, and the left lead 451 of motor 410 is connected to ground. In this way, motor 400 may run in a reverse direction.

Accordingly, discussed herein a system for a vehicle may comprise a pump that is selectively fluidically coupled to a vent line upstream of a fuel vapor storage canister positioned in an evaporative emissions system when a routing valve is commanded to a first routing valve position, and that is alternatively selectively fluidically coupled to an ejector system when the routing valve is commanded to a second routing valve position. Such a system may further comprise a a controller with computer readable instructions stored on non-transitory memory that when executed during an engine-off condition, cause the controller to command the routing valve to the second position, activate the pump to route a positive pressure to the ejector system, monitor a vacuum generated via the ejector system responsive to routing the positive pressure to the ejector system, and indicate that the ejector system is degraded responsive to the vacuum failing to reach or exceed a vacuum build threshold.

Such a system may further comprise a fuel system selectively fluidically coupled to the evaporative emissions system via a fuel tank isolation valve, the fuel system including a fuel tank pressure transducer. The controller may store further instructions to command open the fuel tank isolation valve and monitor the vacuum generated via the ejector system via the fuel tank pressure transducer.

For such a system, the pump may be fluidically coupled to the ejector system when the routing valve is commanded to the second routing valve position by way of an engine-off boost conduit, the engine-off boost conduit further including an engine-off boost conduit valve. In such an example, the controller may store further instructions to command open the engine-off boost conduit valve in order to route the positive pressure to the ejector system.

Such a system may further comprise a conduit positioned upstream of the ejector system that receives the positive pressure that is routed to the ejector system. The conduit may further include a passive check valve that prevents the positive pressure from being routed to an intake conduit of an engine of the vehicle.

Such a system may further comprise a canister purge valve positioned in a purge conduit that couples the fuel vapor storage canister to an engine intake and to the ejector system. In such an example, the controller may store further instructions to command open the canister purge valve when routing the positive pressure to the ejector system.

As discussed above, it may be desirable to rely on ELCM 182 to introduce positive pressure into ejector system 141 during engine-off conditions, as there may be limited and/or insufficient times for doing so during engine-on operation. The introduction of such positive pressure to the ejector system may be used to diagnose whether the ejector (e.g. 140) and/or CV2 (e.g. 170) are degraded, or are functioning as desired. However, in order to accurately assess presence or absence of degradation of the ejector and/or CV2, certain conditions may first have to be met.

One such condition includes an indication that the EOBC (e.g. 185) is not degraded, and that the EOBC valve (e.g. 189) is not stuck closed. Accordingly, turning to FIG. 5, an example method 500 is depicted, detailing methodology for determining whether the EOBC is degraded and whether the EOBC valve is stuck closed or not. Method 500 will be described with reference to the systems described herein and shown in FIGS. 1-4B, though it will be appreciated that similar methods may be applied to other systems without departing from the scope of this disclosure. Instructions for carrying out method 500 and the rest of the methods included herein may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the methods depicted below.

Method 500 begins at 503 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 506, method 500 includes indicating whether conditions are met for conducting the EOBC diagnostic. In one example, conditions being met may include an indication that the engine is not combusting air and fuel. However, in other examples, conditions being met may include an indication that the engine is operating to combust air and fuel, provided that the engine is not operating in boost mode (in other words, provided there is not a positive pressure with respect to atmospheric pressure present in the intake passage (e.g. 118). For example, an engine idle condition where intake manifold vacuum is present, may comprise a circumstance where conditions are indicated to be met. Conditions being met at 506 may additionally or alternatively include an indication that a predetermined amount of time (e.g. 5 days, 3 days, 2 days, 1 day, etc.) has elapsed since a prior EOBC diagnostic was conducted. Conditions being met at 506 may additionally or alternatively include an indication that there is not already degradation indicated for the EOBC (e.g. 185) and/or the EOBC valve (e.g. 189). Conditions being met at 506 may additionally or alternatively include an indication that the ELCM is not being utilized for another diagnostic purpose. Conditions being met at 506 may additionally or alternatively include an indication that a canister purging operation is not in progress. In some examples, conditions being met may include a key-off event, or may include an indication that the controller has been woken up from a sleep state to conduct the diagnostic.

If, at 506, conditions are not indicated to be met for conducting the EOBC diagnostic, method 500 may proceed to 509. At 509, method 500 may include maintaining current vehicle operating status. For example, the RV (e.g. 186) may be maintained in its current configuration, the ELCM (e.g. 182) may be maintained in its current state of operation, the EOBC valve (e.g. 189) may be maintained in its current state of operation, etc. Method 500 may then end.

Returning to 506, in response to conditions being met for conducting the EOBC diagnostic, method 500 may proceed to 512. At 512, method 500 may include commanding the RV to the second RV position. Proceeding to 515, method 500 may include commanding or maintaining the ELCM COV (e.g. 315) in the first position. Proceeding to 518, method 500 may include activating the ELCM pump in the forward mode, also referred to herein as the vacuum-mode of operation, to draw air flow across the reference orifice (e.g. 340), as depicted at FIG. 3A. The ELCM pump may be operated in vacuum-mode for a predetermined duration, and/or until a steady-state pressure as monitored via the ELCM pressure sensor (e.g. 183) is indicated. The steady-state pressure or reference pressure may comprise a threshold pressure that may subsequently be used for conducting the EOBC diagnostic.

Accordingly, with the reference pressure obtained at 521, method 500 may proceed to 524. At 524, method 500 may include commanding the ELCM COV to the second position, and commanding or maintaining closed the EOBC valve. Continuing at 527, method 500 may include activating the ELCM pump in the vacuum-mode, to draw a vacuum on the EOBC. Once the ELCM pump is activated to draw the negative pressure with respect to atmospheric pressure on the EOBC, method 500 may proceed to 530. At 530, method 500 may include monitoring the vacuum build via the ELCM pressure sensor. While not explicitly illustrated, monitoring the vacuum build may include monitoring the vacuum build for a predetermined duration, the predetermined duration comprise an amount of time where, if there is an absence of degradation of the EOBC, then it may be expected that the vacuum would build to the reference pressure obtained at step 521.

Accordingly, at 533, method 500 may include indicating whether the vacuum build has reached or exceed the reference pressure. If so, then method 500 may proceed to 536, where an absence of degradation of the EOBC may be indicated. Furthermore, it may be indicated that the EOBC valve is not degraded, at least in terms of sealing the EBOC line. Such results may be stored at the controller.

Proceeding to 539, method 500 may include deactivating the ELCM pump. However, while not explicitly illustrated, it may be understood that the ELCM COV may be maintained in the second COV position. In this way, the vacuum in the EOBC may be trapped due to the ELCM COV being in the second COV position and the EOBC valve being closed.

Continuing to 542, method 500 may include commanding open the EOBC valve. It may be understood that commanding the EOBC valve open may relieve the pressure trapped in the EOBC, provided that the EOBC valve opens when commanded to do so via the controller. Accordingly, at 545, method 500 may include indicating whether the vacuum is relieved, or in other words, if the EOBC pressure returns to atmospheric pressure (or within a predetermined threshold such as less a 5% difference or less from atmospheric pressure) upon the commanding open of the EOBC valve. If so, then method 500 may proceed to 548, where it may be indicated that the EOBC valve is not stuck closed. In other words, because commanding open the EOBC valve resulted in the pressure in the EOBC being relieved, then the EOBC valve must have opened. Such a result may be stored at the controller. Continuing at 551, method 500 may include commanding closed the EOBC valve.

Returning to 545, if pressure decay is not indicated, or in other words, if the pressure decay has not resulted in pressure in the EOBC line being relieved to within the predetermined threshold of atmospheric pressure, then method 500 may proceed to 554. At 554, method 500 may include indicating the EOBC valve is stuck closed. Such a result may be stored at the controller. Continuing at 551, method 500 may include commanding closed the EOBC valve.

Returning to 533, under circumstances where the vacuum build did not reach or exceed the reference pressure, then method 500 may proceed to 557 where a presence of degradation of the EOBC may be indicated. In other words, because the ELCM pump was unable to pull draw down pressure in the EOBC to the reference pressure, either the EOBC includes a source of degradation greater than the size of the reference orifice associated with the ELCM, or the EOBC valve is stuck open. Such a result may be stored at the controller. Proceeding to 560, method 500 may include deactivating the ELCM pump.

Whether EOBC degradation is indicated (step 557), a stuck closed EOBC valve is indicated (step 554) or that the EOBC valve is not stuck closed is indicated (step 548), at 563, method 500 may include commanding the ELCM COV to the first position. In doing so, if there is any pressure that remains trapped in the EOBC, then the pressure may be relieved via the ELCM COV being in the first position (refer to FIG. 3C). Proceeding to 567, method 500 may include commanding the RV to the first RV position. Continuing at 570, method 500 may include updating vehicle operating conditions. Specifically, if there is EOBC degradation or if the EOBC valve is stuck closed, then updating vehicle operating conditions may include preventing the conducting of the diagnostic to assess ejector system functionality (see FIG. 9) that relies on the ELCM pump introducing positive pressure with respect to atmospheric pressure into the ejector system via the EOBC. Furthermore, in response to an indication of EOBC degradation or that the EOBC valve is stuck closed, a malfunction indicator light (MIL) may be illuminated at the vehicle dash, alerting the vehicle operator of a request to service the vehicle to mitigate the issue. Method 500 may then end.

As discussed, another condition which may adversely impact the diagnostic for assessing ejector system functionality by introducing positive pressure to the ejector system via the EOBC may include a stuck open CV3 (e.g. 184). Specifically, a stuck open CV3 may result in insufficient positive pressure being introduced to the ejector system for conducting the ejector system diagnostic as per FIG. 9. Accordingly, turning to FIG. 6, an example method 600 is depicted, detailing a diagnostic routine for determining whether the CV3 (e.g. 184) is stuck open. Specifically, method 600 includes commanding the RV to the second position, and commanding the EOBC valve open, then directing a positive pressure with respect to atmospheric pressure to the ejector system via the ELCM operating in the pressure-mode, and monitoring pressure in an intake of the engine downstream of the charge air cooler. A pressure change greater than a predetermined pressure change threshold in the intake passage (e.g. 118) may indicate that the CV3 is stuck open. If the CV3 were not stuck open, then an absence of pressure change would be expected in the intake passage.

As discussed, instructions for carrying out method 600 may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the method depicted below.

Method 600 begins at 605 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 610, method 600 may include indicating whether conditions are met for conducting the CV3 diagnostic. Conditions being met at 610 may include an indication that the EOBC is free from degradation, and that the EOBC valve is not stuck closed (see methodology of FIG. 5). Conditions being met at 610 may additionally or alternatively include an indication that the engine is not combusting air and fuel. For example, conditions being met may include a key-off event where the controller is kept awake to conduct the diagnostic, or a situation where the controller is awoken from a sleep state at a particular time during a key-off condition, to conduct the diagnostic. In some examples, conditions being met at 610 may include a condition such as a start/stop event where the engine is pulled down at a stop (e.g. stoplight, in response to traffic conditions, etc.). Conditions being met at 610 may additionally or alternatively include an indication that pressure in the intake passage (e.g. 118) is within a threshold (e.g. within 5% or less) of atmospheric pressure, as monitored via, for example, a pressure sensor (e.g. 117) positioned therein. Conditions being met at 610 may additionally or alternatively include an indication that a predetermined amount of time (e.g. 5 days, 3 days, 2 days, 1 day, etc.) has elapsed since a prior CV3 diagnostic.

If, at 610, conditions are not indicated to be met for conducting the CV3 diagnostic, method 600 may proceed to 615. At 615, method 600 may include maintaining current vehicle operating status. For example, the RV may be maintained in its current status, the ELCM pump may be maintained in its current operational state, the ELCM COV may be maintained in its current operational position, the EOBC valve may be maintained in its current state, the engine may be maintained in its current operational state, etc. Method 600 may then end.

Returning to 610, in response to conditions being indicated to be met for conducting the CV3 diagnostic, method 600 may proceed to 620. At 620, method 600 may include commanding the RV to the second RV position. While not explicitly illustrated, it may be understood that the CPV may be commanded or maintained closed. Proceeding to 625, method 600 may include commanding the EOBC valve open, and commanding the ELCM COV to the second position.

Continuing at 630, method 600 may include activating the ELCM pump in the reverse mode of operation, also referred to herein as the pressure-mode of operation (refer to FIG. 3D for a relevant illustration of the ELCM COV in the second position and the ELCM pump activated in the pressure mode). In this way, a positive pressure may be introduced into the EOBC and then to the conduit (e.g. 148) that leads to the ejector system.

With the ELCM pump configured in the pressure-mode with the RV in the second RV position and the EOBC valve commanded open, method 600 may proceed to 635. At 635, method 600 may include monitoring pressure in the intake conduit (e.g. 118) downstream of the charge air cooler (e.g. 156) via a pressure sensor (e.g. 117) positioned in the intake conduit. Monitoring the pressure may include monitoring the pressure for a predetermined duration (e.g. 1 minute, 2 minutes, 3 minutes, etc.). Continuing at 640, method 600 may include indicating whether a pressure change in the intake conduit is greater than an intake conduit pressure change threshold. The intake conduit pressure change threshold may comprise a positive (with respect to atmospheric pressure) non-zero pressure threshold. The intake conduit pressure change threshold may comprise 5 $InH_2O$, 8 $InH_2O$, etc.

If, at 640, the pressure change in the intake conduit is not greater than the intake conduit pressure change threshold, then method 600 may proceed to 645. At 645, method 600 may include indicating that the CV3 is not stuck open. Alternatively, if at 640, the pressure change in the intake conduit is greater than the intake conduit pressure change threshold, then method 600 may proceed to 650, where it may be indicated that the CV3 is stuck open. Whether the CV3 is indicated to be stuck open (step 650) or not (step 645), method 600 may store the result at the controller. Method 600 may then proceed to 655, where the controller may deactivate the ELCM pump.

With the ELCM pump deactivated at 655, method 600 may proceed to 660. At 660, method 600 may include commanding the RV to the first position, commanding the ELCM COV to the first position, and commanding the EOBC valve closed. Continuing at 665, method 600 may include updating vehicle operating conditions. Specifically, a MIL may be illuminated at the vehicle dash responsive to an indication that the CV3 is stuck open, alerting the vehicle operator of a request to service the vehicle. Furthermore, in a case where the CV3 is indicated to be stuck open, the diagnostic for determining whether the ejector system is functioning as desired which relies on introducing positive pressure to the ejector system via ELCM pump operation (refer to FIG. 9), may be prevented as any results of the diagnostic may be challenging to interpret due to the stuck open CV3. Method 600 may then end.

As will be discussed in further detail below with regard to FIG. 9 (and also FIG. 10) diagnosing the ejector system via the introduction of positive pressure to the EOBC line and then to the ejector system, may include commanding open the CPV and the FTIV, and relying on pressure change as monitored via the FTPT (e.g. 107) to indicate whether the ejector system is degraded or not. Accordingly, other conditions which must be met prior to conducting the ejector system diagnostic may include an indication that the CPV is not stuck closed, that the FTIV is not stuck closed and that there is an absence of a source of undesired evaporative emissions stemming from the fuel system and evaporative emissions system.

Accordingly, a diagnostic to assess such parameters is depicted at FIG. 7. Specifically, FIG. 7 depicts a method for assessing presence or absence of a source of undesired evaporative emissions stemming from the fuel system and/or evaporative emissions system, and whether the CPV and/or FTIV is stuck closed. The methodology depicted at FIG. 7 relies on engine intake manifold vacuum for conducting the diagnostic, while the engine is operating to combust air and fuel.

As discussed, instructions for carrying out method 700 may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the method depicted below.

Method 700 begins at 705 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 710, method 700 may include indicating whether conditions are met for conducting the natural aspiration evaporative emissions test diagnostic (also referred to herein as natural aspiration evap test). Conditions being met at 710 may include an intake manifold vacuum greater than a predetermined intake manifold vacuum threshold. The intake manifold vacuum threshold may comprise a non-zero, negative pressure threshold with respect to atmospheric pressure. Conditions met at 710 may additionally or alternatively include an indication that a predetermined duration of time (e.g. 5 days, 3 days, 2 days, 1 day, etc.) has elapsed since a prior natural aspiration evap test was conducted. Conditions being met at 710 may additionally or alternatively include an indication that a canister purging event is not in progress. Conditions being met at 710 may additionally or alternatively include an indication that no prior degradation of the CPV, FTIV fuel system and evaporative emissions system is indicated. Conditions being met at 710 may additionally or alternatively include an indication that the engine is operating to combust air and fuel, and that the vehicle is stopped (e.g. at a stoplight).

If, at 710, it is indicated that conditions are not met for conducting the diagnostic, method 700 may proceed to 715. At 715, method 700 may include maintaining current vehicle operating conditions. Specifically, the engine may be maintained in its current state of operation, the CPV and FTIV may be maintained in their current operational states, the RV may be maintained in its current state, the ELCM pump and COV may be maintained in their current states, etc. Method 700 may then end.

Alternatively, responsive to conditions being met for conducting the natural aspiration evap test at step 710, method 700 may proceed to 720. At 720, method 700 may include commanding the RV to the first RV position, and may further include commanding the ELCM COV to the second COV position. In this way, the canister may be fluidically coupled to the ELCM, and the ELCM COV may seal the canister from atmosphere.

Proceeding to 725, method 700 may include commanding open the CPV, and may further include commanding open the FTIV. In this way, intake manifold vacuum may be communicated to the fuel system and evaporative emissions system. Accordingly, continuing at step 730, method 700 may include monitoring the vacuum build in the fuel system and evaporative emissions system via the FTPT (e.g. 107). It may be understood that the reason for relying on the FTPT is that the method of FIG. 9 relies on a functional FTPT sensor, and thus the diagnostic discussed at FIG. 7 allows for determining whether the FTPT is functioning as desired or expected. While not explicitly illustrated, it may be understood that in some examples, the vacuum build may be additionally monitored via the ELCM pressure sensor (e.g. 183). It may be understood that monitoring the vacuum build may comprise monitoring the vacuum build for a predetermined threshold duration (e.g. 1 minute or less, 2 minutes or less, etc.)

Continuing to 735, method 700 may include indicating whether the vacuum build has reached or exceeded a predetermined vacuum build threshold. For example, the vacuum build threshold may comprise −8 $InH_2O$, −12 $InH_2O$, etc. If, at 735, it is indicated that the vacuum build has reached the predetermined vacuum build threshold, method 700 may proceed to 740. At 740, method 700 may include indicating that the CV1, FTIV, and CPV are not stuck closed, and that there is not a source of gross undesired evaporative emissions stemming from the fuel system and/or evaporative emissions system (which may include a stuck open CV2). In other words, if any one of the CV1, FTIV, and/or CPV were stuck closed, then intake manifold vacuum would fail to reach the FTPT, thus the vacuum build would not be able to reach or exceed the predetermined vacuum build threshold.

Continuing to 745, method 700 may include commanding closed the CPV, and conducting a pressure bleedup test. Specifically, by commanding closed the CPV, the intake manifold vacuum may be sealed from the fuel system and evaporative emissions system, and the fuel system and evaporative emissions system may thus be sealed from engine intake and from atmosphere. Accordingly, pressure in the sealed fuel system and evaporative emissions system may be monitored via the FTPT, and compared to a predetermined bleedup threshold. The bleedup threshold may be a function of one or more of fuel level, ambient temperature, RVP of fuel in the fuel tank, fuel tank size, etc. The predetermined bleedup threshold may relate to a size of a source of undesired evaporative emissions that the diagnostic is testing for. The predetermined bleedup threshold may comprise a non-zero, negative pressure threshold, that is somewhere between the vacuum build threshold and atmospheric pressure. In other examples, the pressure bleedup threshold may comprise a pressure bleedup rate.

Accordingly, continuing to 750, if the pressure in the fuel system and/or evaporative emissions remains below the predetermined pressure bleedup threshold, or rises at a rate slower than the predetermined pressure bleedup rate, then method 700 may proceed to 755, where an absence of undesired evaporative emissions may be indicated. Alternatively, if the pressure bleedup rises at a rate faster than the predetermined pressure bleedup rate, or exceeds the predetermined pressure bleedup threshold at 750, then the presence of undesired evaporative emissions may be indicated. It may be understood that the undesired evaporative emissions indicated at step 760 may comprise non-gross undesired evaporative emissions (e.g. 0.02" source, or 0.04" or less source) as compared to the gross undesired evaporative emissions (e.g. 0.09" source or greater) discussed above at step 740.

Whether undesired evaporative emissions are indicated or not, the result may be stored at the controller at 765, and vehicle operating parameters may be updated. For example, if undesired evaporative emissions are indicated, then it may not be desirable to conduct the ejector system diagnostic of FIG. 9, as the results may be confounded due to the source of undesired evaporative emissions stemming from the fuel system and/or evaporative emissions system. Alternatively, an absence of a source of undesired evaporative emissions may enable the ejector system diagnostic of FIG. 9 to be conducted, provided all conditions are met for doing so.

Returning to 735, if the vacuum build threshold is not reached, then method 700 may proceed to 770. At 770, method 700 may include indicating that there may be gross undesired evaporative emissions present in the fuel system and/or evaporative emissions system, that one or more of the CV1, FTIV, or CPV may be stuck closed, and/or that the CV2 may be stuck open. Any one of the above issues may result in the failure of the engine intake manifold vacuum to draw down pressure in the fuel system and evaporative emissions system.

Proceeding to 765, method 700 may include storing the result at the controller, and may further include updating vehicle operating parameters, as discussed above. Specifically, due to the failure of the intake manifold vacuum to draw down pressure in the fuel system and evaporative emissions system to the vacuum build threshold, updating vehicle operating parameters may include preventing the ejector system diagnostic of FIG. 9 from being conducted. In a circumstance where potential undesired evaporative emissions are indicated and/or that one or more of the CPV and FTIV is stuck closed, updating vehicle operating parameters at 765 may include scheduling a follow-up test in an attempt to further isolate the issue. Such a test may comprise the test diagnostic discussed below at FIG. 8.

Accordingly, whether an absence of non-gross undesired evaporative emissions is indicated (step 755), a presence of non-gross undesired evaporative emissions is indicated (step 760), or in response to the failure of the intake manifold vacuum to reach the vacuum build threshold (step 770), method 700 may proceed from step 765 to step 775. At 775, method 700 may include commanding closed/maintaining closed the CPV, and commanding the ELCM COV to the first position. In this way, pressure in the fuel system and evaporative emissions system may be relieved to atmosphere. Proceeding to 780, method 700 may include commanding closed the FTIV. Method 700 may then end.

Turning now to FIG. 8 a high level example method is depicted, detailing a diagnostic (referred to herein as ELCM evap test) for determining presence or absence of undesired evaporative emissions stemming from the fuel system and evaporative emissions system, and which can indicate whether the FTIV is stuck closed, the CPV is stuck closed and/or whether one or more of the CV1 and CV2 are stuck open.

As discussed, instructions for carrying out method 800 may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the method depicted below.

Method 800 begins at 805 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 810, method 800 may include indicating whether conditions are met for conducting the ELCM evap test. Conditions being met may include an indication that a canister purging event is not in progress. Conditions being met may additionally or alternatively include an indication that another (e.g. intake manifold vacuum-based) evap diagnostic is not in progress. Conditions being met may additionally or alternatively include an indication that another diagnostic that relies on the ELCM pump is not in progress. Conditions being met may additionally or alternatively include an indication that a refueling event is not in progress. Conditions being met may include an engine-off condition. For example, conditions being met may include an indication that the vehicle is operating in an electric-only mode, or that the vehicle is stopped and the engine has been pulled down such as may occur at a start/stop event. Conditions being met may additionally or alternatively include a key-off event where the controller is kept awake to conduct the diagnostic of FIG. 8. Conditions being met may additionally or alternatively include an indication that the controller has been woken up to specifically conduct the diagnostic. Conditions being met may include an indication that the intake manifold vacuum-based diagnostic of FIG. 7 returned a result that there may be a source of gross undesired evaporative emissions and/or that one or more of the CPV and FTIV may be stuck closed.

If, at 810, conditions are not met, then method 800 may proceed to 815 where current vehicle operating conditions are maintained, similar to that discussed above at steps 509, 615, and 715 of methods 500, 600 and 700, respectively. Method 800 may then end.

Alternatively, responsive to conditions being met at 810 for conducting the ELCM-based evap test, method 800 may proceed to 820. At 820, method 800 may include commanding or maintaining the RV in the first RV position, and may further include commanding or maintaining the ELCM COV in the first COV position. Continuing at 825, method 800 may include activating the ELCM pump in the forward mode, or vacuum-mode, to draw a vacuum across the reference orifice of the ELCM (refer to FIG. 3A), to obtain a reference pressure. The ELCM pump may be operated in vacuum-mode for a predetermined duration, and/or until a steady-state pressure as monitored via the ELCM pressure sensor (e.g. 183) is indicated. The steady-state pressure or reference pressure may comprise a threshold pressure that may subsequently be used for conducting the diagnostic of FIG. 8.

Accordingly, responsive to the reference pressure being obtained at 830, method 800 may proceed to 835. At 835, method 800 may include deactivating the ELCM pump to relieve the pressure, then the CPV may be commanded or maintained closed, and the FTIV may be commanded open. Commanding the FTIV open while the ELCM pump is off and the ELCM COV is in the first position may allow fuel system depressurization. Next, the ELCM COV may be commanded to the second COV position, and the ELCM pump may be re-activated in the vacuum-mode of operation.

Proceeding to 840, method 800 may include monitoring the vacuum build. The vacuum build may be monitored via the FTPT (e.g. 107) and in some examples, additionally via the ELCM pressure sensor (e.g. 183). Continuing to 845, method 800 may include indicating whether the vacuum build has reached or exceeded the reference pressure. If the reference pressure is reached or exceeded, then method 800 may proceed to 850, where an absence of degradation stemming from the fuel system and evaporative emissions system may be indicated. Specifically, because the vacuum build was monitored via the FTPT, and because the vacuum build reached or exceed the reference pressure, then the FTIV cannot be stuck closed. Furthermore, because the reference pressure was reached or exceeded, there is not a source of undesired evaporative emissions stemming from the fuel system and evaporative emissions system, otherwise the ELCM pump would not have been able to draw down pressure in the fuel system and evaporative emissions system to the reference pressure. However, there may be the potential for the CPV to be stuck closed.

Accordingly, proceeding to 855, method 800 may include commanding open the CPV. Continuing to 860, method 800 may include indicating whether a pressure inflection point is indicated. Specifically, commanding open the CPV is expected to increase a size of the evaporative emissions system and fuel system that is being evacuated, to a size that is defined by the two check valves (CV1 and CV2), the ELCM COV, and the fuel system. Accordingly, if the CPV is functioning as desired, a brief decrease in negative pressure (in other words, a brief change to a slightly less negative pressure) may be expected. Accordingly, if, at 860, such an inflection point is not indicated, method 800 may proceed to 865, where it may be indicated that the CPV is stuck closed. Such a result may be stored at the controller.

Alternatively, returning to 860, if an inflection point is indicated, method 800 may proceed to 880. At 880, method 800 may include indicating whether the vacuum build again reaches or exceeds the reference pressure. Specifically, both the CV1 and CV2 may be expected to close upon vacuum being directed at them from the ELCM pump when the ELCM pump is fluidically coupled to the canister as depicted at FIG. 1. Accordingly, if the vacuum does not again build to the reference pressure upon opening the CPV, then method 800 may proceed to 885, where the CV1 and/or CV2 may be indicated to be stuck open. Such a result may be stored at the controller. Alternatively, if the vacuum build does reach or exceed the reference pressure at 880, method 800 may proceed to 890, where it may be indicated that the CPV is not stuck closed and the neither the CV1 nor the CV2 are stuck open. Such results may then be stored at the controller.

Returning to 845, in a situation where the vacuum build failed to reach the reference pressure with the CPV closed, method 800 may proceed to 895, where the presence of degradation may be indicated. Degradation may include one or more of a stuck closed FTIV (because the FTPT is used to monitor the vacuum build) and a source of undesired evaporative emissions stemming from the fuel system and/or evaporative emissions system. Such results may be stored at the controller.

Whether the presence of degradation is indicated at step 895, the CPV is indicated to be stuck closed at step 865, the CPV is not indicated to be stuck closed nor is the CV1 nor CV2 at step 890, or if one or more of the CV1 and CV2 are indicated to be stuck open at 885, method 800 may proceed to 870. At 870, method 800 may include deactivating the ELCM pump, and commanding the ELCM COV to the first COV position. At step 870, method 800 may further include commanding closed or maintaining closed the CPV. With the COV in the first COV position, pressure in the fuel system and evaporative emissions system may be relieved.

Continuing to 875, method 800 may include commanding closed the FTIV. Proceeding to 880, method 800 may include updating vehicle operating conditions. Updating vehicle operating conditions may include any one of the following examples. As one example, responsive to the CV1 and/or CV2 being stuck open (step 885), the controller may prevent the ejector system diagnostic of FIG. 9 from being conducted, as the diagnostic relies on a functional CV1, and since the diagnostic of FIG. 8 indicated the CV1 may be stuck open. As another example, the controller may prevent the ejector system diagnostic of FIG. 9 from being conducted responsive to the indication that the CPV is stuck closed (see step 865). As yet another example, the controller may prevent the ejector system diagnostic of FIG. 9 from being conducted responsive to the indication of the presence of evaporative emissions system and/or fuel system degradation, as discussed with regard to step 895. Alternatively, the indication that the FTIV is not stuck closed, that the CPV is not stuck closed, that neither the CV1 nor CV2 is stuck open, and that there is an absence of undesired evaporative emissions stemming from the fuel system and evaporative emissions system, may be permissive for allowing the methodology of FIG. 9 to be conducted when all conditions are met for doing so. Furthermore, updating vehicle operating conditions at 880 may include setting appropriate MIL(s) to alert the vehicle operator of request(s) to service the vehicle in the case where degradation is determined.

As discussed above, boosted engine operation may occur infrequently, and even when requested, may comprise durations of time that are not sufficient to robustly and accurately diagnose proper functionality of the vehicle ejector system. Accordingly, as discussed above, the systems of FIGS. 1-4B may enable such diagnostics to be conducted without relying on engine operation. Turning to FIG. 9, an example method 900 is shown, illustrating how such a diagnostic may be conducted by relying on a positive pressure with respect to atmospheric pressure being introduced to the ejector system via ELCM pump operation. Specifically, by commanding the RV (e.g. 186) to the second position and actuating the ELCM pump to supply positive pressure to the ejector system, the ejector system may be diagnosed as will be elaborated below.

As discussed, instructions for carrying out method 900 may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the method depicted below.

Method 900 begins at 905 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 910, method 900 may include indicating whether conditions are met for conducting the ELCM-based boost test. Discussed herein, the ELCM-based boost test may also be referred to as "engine-off boost test." Conditions being met at 910 may include an engine-off condition. In some examples, the engine-off condition may comprise a start/stop event, where the engine is pulled down in response to vehicle speed dropping below a threshold vehicle speed (e.g. when the vehicle is stopped in traffic, at a stoplight, etc.). In other examples, the engine-off condition may comprise a key-off event where the controller is kept awake to conduct the diagnostic, and after which, the controller may be slept. In still other examples, the engine-off condition may comprise a situation where the engine is woken up at a predetermined time in order to conduct the engine-off boost diagnostic.

Conditions being met at 910 may additionally or alternatively include an indication that the EOBC (e.g. 185) is not degraded, and that the EOBC valve (e.g. 189) is not stuck closed (refer to FIG. 5). Conditions being met at 910 may additionally or alternatively include an indication that the CV3 (e.g. 184) is not stuck open (refer to FIG. 6). Conditions being met at 910 may additionally or alternatively include an indication that the CPV (e.g. 158) and the FTIV (e.g. 181) are not stuck closed, and that at least the CV1 is not stuck open (refer to FIGS. 7-8). Conditions being met at 910 may additionally or alternatively include an indication that there is an absence of sources of undesired evaporative emissions stemming from the fuel system and evaporative emissions system. Conditions being met at 910 may additionally or alternatively include an indication that the canister (e.g. 104) is substantially clean (e.g. loaded to less than 5%), so that the diagnostic does not draw an undesirable amount of fuel vapors to the engine (which is off). It may be understood that by conducting the diagnostic while the canister is substantially clean, all fuel vapors desorbed to engine intake may be adsorbed via the AIS HC trap (e.g. 169). Conditions being met at 910 may additionally or alternatively include an indication that a drive cycle just prior to a key-off event did not include boosted engine operation, and thus an engine-on boost diagnostic was not able to be conducted. In some examples, the controller may learn particular driving routines over time, or may rely on driving route information input into the onboard navigation system, and thus may be able to predict certain drive cycles that will not encounter boosted engine operation. In such an example, conditions being met may include an engine-off condition (e.g. start/stop event) where it is further indicated that boosted engine operation is predicted not to occur during the current drive cycle.

If, at 910, conditions are not indicated to be met for conducting the engine-off boost diagnostic, method 900 may proceed to 915. At 915, method 900 may include maintaining current vehicle operating conditions. For example, if the engine is in operation, then such operation may be maintained and the RV is not commanded to the second RV position. Other parameters such as the current position of the RV, current status of the ELCM pump and ELCM COV, current status of the CPV and FTIV, etc., may be maintained. Method 900 may then end.

Returning to 910, responsive to conditions being met for conducting the engine-off boost test, method 900 may proceed to 920. At 920, method 900 may include commanding the RV to the second RV position (refer to FIG. 2). Proceeding to 925, method 900 may include commanding the EOBC valve open, and commanding the ELCM COV to the second COV position. Furthermore, at 925, method 900 may include commanding open the CPV and the FTIV. While not explicitly illustrated, in some examples, if there is a positive pressure in the fuel system greater than a threshold positive pressure, then the FTIV may be commanded open with the RV in the first RV position and with the ELCM COV in the first COV position, to vent fuel vapors to the canister until the fuel system is depressurized, and then the RV may be commanded to the second RV position, the COV commanded to the second COV position, the EOBC valve commanded open, and the CPV commanded open.

With the RV in the second RV position and the EOBC valve open, it may be understood that the ELCM pump may be fluidically coupled to the conduit (e.g. 148) that leads to the ejector system. Furthermore, the ejector system may be fluidically coupled to the evaporative emissions system and fuel system due to the open CPV and FTIV. Still further, it may be understood that the fuel system and the evaporative emissions system may be sealed from atmosphere, due to the position of the RV (refer to the position of the RV at FIG. 2).

Accordingly, proceeding to 930, method 900 may include activating the ELCM pump in the pressure mode, or reverse mode, of operation. In this way, positive pressure may be directed through the EOBC and into the ejector system, which may generate a vacuum that is applied on the fuel system and evaporative emissions system.

Proceeding to 935, method 900 may include indicating whether the vacuum build is greater than a threshold vacuum build. In some examples, the threshold vacuum build may comprise the same threshold vacuum build as that referred to above at FIGS. 7-8. However, in other examples the threshold vacuum build may be different, without departing from the scope of this disclosure. In some examples, the threshold vacuum build may be a function of fuel level in the fuel tank, fuel tank and/or fuel temperature, ambient temperature, fuel RVP, etc. For example, the vacuum threshold may be made less negative as fuel vaporization increases, which may be dependent on ambient temperature and/or fuel temperature, fuel level, fuel RVP, etc. It may be understood that, because the ELCM is coupled to the EOBC, the ELCM pressure sensor may not be relied upon for monitoring the vacuum in the fuel system and evaporative emissions system. Accordingly, monitoring the vacuum build at 935 may include monitoring the vacuum build via the FTPT (e.g. 107). It may be understood that the monitoring of the vacuum build at 935 may comprise monitoring the vacuum build for a predetermined duration (e.g. 1 minute or less, 2 minutes or less, 3 minutes or less, etc.).

Continuing to 937, method 900 may include indicating whether the vacuum build has reached or exceeded (e.g. become more negative than) the threshold vacuum build. If so, then method 900 may proceed to 940. At 940, method 900 may include indicating an absence of ejector system degradation. In other words, because the threshold vacuum build was reached or exceeded at 937, it may be understood that the CV2 opened to communicate vacuum from the ejector system to the fuel system and evaporative emissions system, and the communication of vacuum from the ejector system implies that the ejector (e.g. 140) is functioning as desired. Such a result may be stored at the controller.

Returning to 937, in the event that the vacuum build does not reach or exceed the threshold vacuum build, method 900 may proceed to 960. At 960, method 900 may include indicating ejector system degradation. Specifically, either the ejector or the CV2 may be degraded. For example, a stuck closed CV2 may result in the vacuum build failing to reach or exceed the threshold vacuum build. Additionally or alternatively, a malfunctioning ejector may be the reason for the vacuum not reaching or exceeding the threshold vacuum build. Such a result may be stored at the controller.

Whether the diagnostic indicates that the ejector system is functioning as desired (step 940), or is degraded (step 960), method 900 may proceed to 945. At 945, method 900 may include deactivating the ELCM pump. Continuing to 950, method 900 may include commanding the RV to the first position, commanding the ELCM COV to the first COV position, and commanding both the CPV and the EOBC valve closed. In this way, the fuel system and evaporative emissions system may be coupled to atmosphere (refer to FIG. 1 and FIG. 3C), so as to relieve any vacuum in the fuel system and evaporative emissions system.

Proceeding to 955, method 900 may include commanding closed the FTIV. Continuing to 957, method 900 may include updating vehicle operating conditions. Responsive to ejector system degradation, a MIL may be illuminated at the vehicle dash, alerting the vehicle operator of a request to have the vehicle serviced. Furthermore, in response to ejector system degradation, in some examples boosted engine operation may be disabled. However, in other examples, boosted engine operation may be maintained, but purging under boosted engine operation may be discontinued. Method 900 may then end.

As discussed above with regard to FIG. 9, in some examples conditions may not be met for conducting the engine-off boost test diagnostic, provided that an engine-on boost diagnostic was able to be conducted during a drive cycle just prior to a key-off event, for example. In another example, if an ejector system diagnostic was conducted under boosted engine operation and then a start/stop event is encountered, conditions may not be met for conducting the engine-off boost diagnostic since an engine-on boost diagnostic has already been conducted. Thus, it may be understood that in some examples, a method may include in a first condition, conducting an engine-on boost diagnostic when conditions are met for doing so, and in a second condition, conducting an engine-off boost diagnostic when conditions are met for doing so. Conditions being met for the second condition may include an indication that the engine-on boost diagnostic was not conducted, or is predicted to not be conducted, for a particular drive cycle, and thus, an engine-off boost diagnostic may be scheduled.

Accordingly, turning to FIG. 10, an engine-on boost diagnostic will be briefly discussed. As discussed, instructions for carrying out method 1000 may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the method depicted below.

Method 1000 begins at 1005 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 1010, method 1000 may include indicating whether conditions are met for conducting an engine-on boost diagnostic. Conditions being met may include an indication of boosted engine operation, for example. In some examples, conditions being met may include a prediction that the boosted engine operation will continue for a duration of time sufficient to conduct the engine-on boost diagnostic. The prediction may be based on one or more of learned driving routines, information input into the onboard navigation system, level of boost requested, etc. In some examples, conditions being met may include an indication that neither the CPV nor FTIV is stuck closed, that at least the CV1 is not stuck open, and that there is an absence of undesired evaporative emissions present in the fuel system and evaporative emissions system (refer to FIGS. 7-8) (although in other examples it may be understood that the engine-on boost diagnostic may be used for determining the presence or absence of undesired evaporative emissions, without departing from the scope of this disclosure).

If, at 1010, conditions are not indicated to be met for conducting the engine-on boost diagnostic, method 1000 may proceed to 1015, where current vehicle operating status may be maintained. Specifically, if the engine is not in operation, then such a condition may be maintained. Alternatively, engine operation may be maintained in its current status provided the engine is operating. Current status of valves including but not limited to the CPV, FTIV, RV, ELCM COV, etc., may be maintained. Method 1000 may then end.

Returning to 1010, responsive to conditions being met for the engine-on boost diagnostic, method 1000 may proceed to 1020. At 1020, method 1000 may include commanding the RV to the first RV position, commanding the EOBC valve closed, and commanding the ELCM COV to the second COV position. In this way, the fuel system and evaporative emissions system may be sealed from atmosphere. While not explicitly illustrated, it may be understood that in some examples, the engine-on boost diagnostic may include commanding open the FTIV as well, however, because the ELCM is fluidically coupled to the canister, the ELCM pressure sensor may be relied upon for the engine-on boost diagnostic, which may enable the FTIV to remain closed in other examples. In examples where the FTIV is commanded open, either the FTPT or the ELCM pressure sensor (or both) may be relied upon for conducting the engine-on boost diagnostic.

Proceeding to 1025, method 1000 may include commanding open the CPV. In this way, the ejector system may be fluidically coupled to the evaporative emissions system (and fuel system if the FTIV is additionally commanded open). Continuing at 1030, method 1000 may include monitoring the vacuum build resulting from boosted engine operation providing positive pressure to the ejector system, and the ejector system in turn communicating a negative pressure with respect to atmospheric pressure on the evaporative emissions system (provided the ejector system is functioning as desired or expected).

Proceeding to 1035, method 1000 may include indicating whether the vacuum build is greater than a threshold vacuum build. In some examples, the threshold vacuum build may comprise the same threshold vacuum build as that discussed above with regard to FIGS. 7-9. However, in other examples, the threshold vacuum build may be different without departing from the scope of this disclosure.

If, at 1035, the threshold vacuum build is reached or exceeded, method 1000 may proceed to 1040. At 1040, method 1000 may include indicating the absence of ejector system degradation. Alternatively, if the vacuum build does not reach or exceed the threshold vacuum build, then method 1000 may proceed to 1055, where the presence of ejector system degradation may be indicated. The results may be stored at the controller.

Whether degradation is indicated or not, method 1000 may proceed to 1045. At 1045, method 1000 may include commanding the ELCM COV to the first COV position, and the CPV may be commanded closed. In this way the evaporative emissions system (and fuel system if the FTIV is also commanded open) may be coupled to atmosphere, to relieve any vacuum introduced to the fuel system and/or evaporative emissions system. In a case where the FTIV is open, then the FTIV may be commanded closed responsive to pressure in the fuel system and evaporative emissions system being relieved to atmosphere.

Continuing to 1050, method 1000 may include updating vehicle operating parameters. Specifically, in a case where degradation is indicated, a MIL may be illuminated at the vehicle dash to alert the vehicle operator of a request to service the vehicle. Furthermore, in a case where ejector system degradation is indicated, in one example boosted engine operation may be prevented until the issue is mitigated, while in other examples boosted engine operation may be allowed, but purging under boosted engine operation may be discontinued. Method 1000 may then end.

Turning now to FIG. 11, depicted is an example method 1100 for purging the canister under intake manifold vacuum conditions. While it is appreciated that purging the canister may also be conducted under boosted engine operation, as recognized herein boosted operation may comprise short durations and/or be infrequent, and thus presented here is a method for purging the canister under intake manifold vacuum conditions. As one condition for entry in the engine-off boost test is that the canister is substantially free of stored fuel vapors, depicted here is methodology to clean the canister under intake manifold vacuum conditions.

As discussed, instructions for carrying out method 1100 may be executed by a controller, such as controller 166 of FIG. 1, based on instructions stored in non-transitory memory, and in conjunction with signals received from sensors of the engine system, such as temperature sensors, pressure sensors, and other sensors described in FIGS. 1-3D. The controller may employ actuators such as RV (e.g. 186), ELCM pump (e.g. 330), COV (e.g. 315), EOBC valve (e.g. 189), CPV (e.g. 158), FTIV (e.g. 181), etc., to alter states of devices in the physical world according to the method depicted below.

Method 1100 begins at 1105 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 1110, method 1100 may include indicating whether conditions are met for purging the canister. Conditions being met may include a canister loading state greater than a predetermined canister loading state, and/or an indication that a refueling event has occurred which has loaded the canister to some extent, but that a canister purging operation has not yet subsequently been conducted. Conditions being met may additionally or alternatively include an indication of an intake manifold vacuum greater than a predetermined threshold intake manifold vacuum. The predetermined threshold intake manifold vacuum may comprise a non-zero, negative pressure threshold with respect to atmospheric pressure, sufficient for purging vapors from the canister, for example.

If, at 1110, conditions are not met for purging the canister, method 1110 may proceed to 1115. At 1115, method 1100 may include maintaining current vehicle operating conditions. For example, engine operation may be maintained as is provided the engine is operating, valves including but not limited to the FTIV, CPV, RV, ELCM COV, etc., may be maintained in their current respective states. The ELCM pump may be maintained in its current operational state, etc. Method 1100 may then end.

Alternatively, responsive to an indication that purging conditions are met at 1110, method 1100 may proceed to 1120. At 1120, method 1100 may include commanding the RV to the first RV position, and may further include commanding the ELCM COV to the first COV position. Proceeding to 1125, method 1100 may include commanding open the CPV. At 1130, method 1100 may include purging the contents of the canister to engine intake for combustion. While not explicitly illustrated, it may be understood that during the purging air/fuel ration may be monitored, for example via the exhaust gas sensor (e.g. 125), so that an amount of fuel vapors being purged from the canister to engine intake may be learned over time. The controller may adjust one or more of fuel injection amount and/or frequency, throttle position, spark timing, etc., to compensate for the fuel vapors being purged to engine intake, in order to maintain a desired air-fuel ratio during the purging event. When an appreciable amount of fuel vapors is no longer being inferred to be inducted to the engine, then it may be indicated that the canister is substantially free of fuel vapors. Accordingly, at step 1135, method 1100 may include indicating whether the canister is substantially free (e.g. loaded to 5% or less) of fuel vapors.

If, at 1135, it is indicated that the canister is substantially free of fuel vapors, method 1100 may proceed to 1140, where the CPV may be commanded closed. The RV and the ELCM COV may be maintained in their current states. Continuing to 1145, method 1100 may include updating vehicle operating parameters, which may include updating the loading state of the canister stored at the controller. A canister purging schedule may additionally be updated as a function of the purging event having taken place. Method 1100 may then end.

Thus, discussed herein, a method may comprise while an engine of a vehicle is off and a set of predetermined conditions are met, directing a positive pressure with respect to atmospheric pressure into an ejector system to communicate a negative pressure with respect to atmospheric pressure on a fuel system and an evaporative emissions system. The method may include indicating that the ejector system is degraded in response to the negative pressure not reaching a vacuum build threshold.

For such a method, directing the positive pressure into the ejector system may further comprise commanding a routing valve to a second routing valve position to selectively couple a pump to the ejector system by way of an engine-off boost conduit, where commanding the routing valve to a first routing valve position alternatively selectively couples the pump to a vent line stemming from a fuel vapor storage canister positioned in the evaporative emissions system. Responsive to the indication that the ejector system is degraded, the method may include preventing purging of fuel vapors from the fuel vapor storage canister under boosted engine operation conditions. In such a method, directing the positive pressure into the ejector system may further comprise commanding open an engine-off boost conduit valve positioned in the engine-off boost conduit upstream of the ejector system. In such a method, the set of predetermined conditions may include at least an indication that the engine-off boost conduit is free from degradation, and an indication that the engine-off boost conduit valve is not stuck closed.

For such a method, the method may further comprise a conduit that receives the positive pressure, the conduit positioned upstream of the ejector system, where the conduit includes a check valve positioned between the ejector system and an engine intake conduit, wherein the check valve functions to prevent the positive pressure from being communicated to the engine intake conduit. In such an example, the set of predetermined conditions may include at least an indication that the check valve is not stuck open.

For such a method, directing the positive pressure to the ejector system to communicate the negative pressure with respect to atmospheric pressure on the fuel system and the evaporative emissions system may further comprise commanding open a canister purge valve positioned in a purge conduit that couples the evaporative emissions system to the ejector system. In such an example, the set of predetermined conditions may include at least an indication that the canister purge valve is not stuck closed.

For such a method, directing the positive pressure to the ejector system to communicate the negative pressure with respect to atmospheric pressure on the fuel system and the evaporative emissions system may further comprise commanding open a fuel tank isolation valve that selectively fluidically couples the fuel system to the evaporative emissions system. In such an example, the set of predetermined conditions may include at least an indication that the fuel tank isolation valve is not stuck closed.

For such a method, indicating that the ejector system is degraded in response to the negative pressure not reaching the vacuum build threshold may further comprise monitoring the negative pressure via a pressure sensor positioned in the fuel system.

For such a method, the set of predetermined conditions may include at least an indication of an absence of a source of undesired evaporative emissions stemming from the fuel system and the evaporative emissions system.

For such a method, the method may further comprise a first check valve positioned between an intake manifold of the engine and the evaporative emissions system. In such an example, the set of predetermined conditions may include at least an indication that the first check valve is not stuck open.

For such a method, directing the positive pressure to the ejector system to communicate the negative pressure on the fuel system and the evaporative emissions system may further comprise sealing the fuel system and the evaporative emissions system from atmosphere.

Another example of a method comprises during a condition where an engine of a vehicle is not combusting air and fuel, selectively fluidically coupling a pump positioned in a vent line stemming from a fuel vapor storage canister to an ejector system, routing a positive pressure with respect to atmospheric pressure into the ejector system via the pump in order to reduce a pressure in a fuel system and an evaporative emissions system of the vehicle, and indicating that the ejector system is not degraded responsive to the pressure in the fuel system and the evaporative emissions system being reduced to a vacuum build threshold.

In such a method, selectively fluidically coupling the pump to the ejector system may further comprise commanding a routing valve from a first routing valve position to a second routing valve position, where the second routing valve position further comprises sealing the fuel system and the evaporative emissions system upstream of the fuel vapor storage canister from atmosphere.

In such a method, the method may further comprise preventing the positive pressure from being routed into an engine intake conduit by a check valve positioned in a conduit upstream of the ejector system that receives the positive pressure being routed to the ejector system.

In such a method, routing the positive pressure to the ejector system may further comprise an indication that the fuel vapor storage canister is substantially free from fuel vapors.

In such a method, the method may further comprise capturing fuel vapors released from the fuel vapor storage canister during routing the positive pressure to the ejector system via an air intake hydrocarbon trap positioned in an intake manifold of the engine.

Turning now to FIG. 12, an example timeline 1200 for conducting diagnostics on the EOBC according to the method of FIG. 5, is shown. Timeline 1200 includes plot 1205, indicating whether conditions are met (yes or no) for conducting the EOBC diagnostic, over time. Timeline 1200 further includes plot 1210, indicating whether the RV (e.g. 186) is in the first RV position or the second RV position, over time. Timeline 1200 further includes plot 1215, indicating whether the ELCM COV (e.g. 315) is in the first COV position or the second COV position, over time. Timeline 1200 further includes plot 1220, indicating whether the EOBC valve (e.g. 189) is open or closed, over time. Timeline 1200 further includes plot 1225, indicating whether the ELCM pump (e.g. 330) is off, or operating in the forward mode, otherwise referred to as the vacuum-mode, over time. Timeline 1200 further includes plot 1230, indicating whether pressure as monitored via the ELCM pressure sensor (e.g. 183), is at atmospheric pressure, or at a negative pressure with respect to atmospheric pressure, over time. Timeline 1200 further includes plot 1235, indicating whether there is EOBC degradation (yes or no), over time. Timeline 1200 further includes plot 1240, indicating whether the EOBC valve is stuck closed (yes or no), over time.

At time t0, conditions are not yet indicated to be met for conducting the EOBC diagnostic (plot 1205). Accordingly, the RV is configured in the first RV position (plot 1210), the ELCM COV is configured in the first COV position (plot 1215), and the EOBC valve is closed (plot 1220). The ELCM pump is off (plot 1225), and pressure as monitored via the ELCM pressure sensor indicates atmospheric pressure, consistent with the evaporative emissions system being fluidically coupled to atmosphere. EOBC degradation is not indicated (plot 1235), and the EOBC valve is not current indicated to be stuck closed (plot 1240).

At time t1, conditions are indicated to be met for conducting the EOBC diagnostic (refer to step 506 of method 500). Accordingly, at time t2, the RV is commanded to the second RV position and the EOBC valve is maintained closed. At time t3, the ELCM pump is commanded on in the forward mode, or in other words, the vacuum mode of operation. Accordingly, with the ELCM COV in the first COV position and the ELCM pump activated in the vacuum mode, the ELCM pump draws a vacuum across the reference orifice (refer to FIG. 3A). Accordingly, the ELCM pressure sensor registers a decrease in pressure between time t3 and t4, and the pressure that is reached, indicated by dashed line 1231, comprises the reference pressure that will be used for the EOBC diagnostic.

With the reference pressure established by time t4, the ELCM pump is deactivated, and pressure as monitored via the ELCM pressure sensor rapidly returns to atmospheric pressure between time t4 and t5. At time t5, the ELCM COV is commanded to the second position, and again the ELCM pump is activated in the vacuum mode of operation. In this way, a vacuum is drawn on the EOBC between time t5 and t6. At time t6, the vacuum reaches the reference pressure. Accordingly, EOBC degradation is not indicated.

With an absence of EOBC degradation indicated at time t6, the EOBC valve is commanded open. Responsive to commanding the EOBC valve open, pressure as monitored via the ELCM pressure sensor rapidly returns to atmospheric pressure between time t6 and t7. Because the commanding open of the EOBC valve resulted in pressure in the EOBC line being relieved, it is indicated that the EOBC valve is not stuck closed. If the EOBC valve were stuck closed, then the pressure relief would not be expected upon the commanding open of the EOBC valve.

With pressure in the EOBC at atmospheric pressure at time t7, the EOBC valve is commanded closed, and conditions are no longer indicated to be met for conducting the EOBC diagnostic. Furthermore, the ELCM COV is commanded to the first COV position. At time t8, the RV is commanded back to the first RV position. In this way, with the ELCM COV in the first COV position and the RV in the first RV position, the evaporative emissions system may be coupled to atmosphere for at least the duration comprising time t8 to time t9.

Turning now to FIG. 13, an example timeline 1300 for diagnosing the CV3 (e.g. 184) according to the method of FIG. 6, is shown. Timeline 1300 includes plot 1305, indicating whether conditions are met (yes or no) for conducting the CV3 diagnostic, over time. Timeline 1300 further includes plot 1310, indicating whether the RV (e.g. 186) is in the first RV position or the second RV position, over time. Timeline 1300 further includes plot 1315, indicating whether the ELCM COV (e.g. 315) is in the first COV position or the second COV position, over time. Timeline 1300 further includes plot 1320, indicating whether the EOBC valve (e.g. 189) is open or closed, over time. Timeline 1300 further includes plot 1325, indicating whether the ELCM pump (e.g. 330) is off, or is operating in the reverse mode, also referred to as the pressure-mode, over time. Timeline 1300 further includes plot 1330, indicating pressure in the intake conduit (e.g. 118), as monitored via a pressure sensor (e.g. 117) positioned therein, over time. Timeline 1300 further includes plot 1335, indicating whether the CV3 is stuck open (yes or no), over time.

At time t0, conditions are not yet indicated to be met for conducting the CV3 diagnostic (plot 1305). The RV is in the first RV position (plot 1310), and the ELCM COV is commanded to the first COV position (plot 1315). The EOBC valve is closed (plot 1320), and the ELCM pump is off (plot 1325). Pressure in the intake conduit (e.g. 118) downstream of the CAC (e.g. 156) is at atmospheric pressure (plot 1330). At time t0, the CV3 is not indicated to be stuck open.

At time t1, conditions are indicated to be met for conducting the CV3 diagnostic (refer to step 610 of method 600). Accordingly, at time t2 the RV is commanded to the second RV position. At time t3, the ELCM COV is commanded to the second position, at time t4 the EOBC valve is commanded open to fluidically couple the EOBC to the conduit (e.g. 148) that leads to the ejector system, and at time t5, the ELCM pump is commanded to operate in the reverse mode of operation, also referred to herein as the pressure mode of operation.

With the ELCM pump operating to pressurize the EOBC, and with the EOBC valve open, it may be understood that if the CV3 were open, a pressure change would be indicated via the pressure sensor (e.g. 117) positioned in the intake conduit. However, between time t5 and t6, no pressure change is indicated, and accordingly pressure in the intake conduit remains below the intake conduit pressure change threshold (refer to step 640 of method 600), represented by dashed line 1331.

At time t6, the predetermined duration for conducting the CV3 diagnostic elapses, and accordingly, conditions are no longer met for conducting the CV3 diagnostic. As the pressure in the intake conduit remained below the intake conduit pressure change threshold, it is indicated that the CV3 is not stuck open. With conditions no longer being indicated to be met for conducting the diagnostic, the ELCM pump is commanded off. At time t7, the EOBC valve is commanded closed. Next, at time t8, the ELCM COV is commanded to the first COV position, and then at time t9 the RV is commanded to the first RV position. Between time t9 and t10, with the ELCM COV in the first COV position and the RV in the first RV position, the evaporative emissions system is coupled to atmosphere.

Turning now to FIG. 14, depicted is example timeline 1400, illustrating how the ELCM pump may be used to provide an indication as to whether the CPV and/or FTIV is stuck closed, whether the CV1 and/or CV2 is stuck open, and whether there is a source of undesired evaporative emissions present in the fuel system and/or evaporative emissions system, according to the method of FIG. 8. Timeline 1400 includes plot 1405, indicating whether conditions are met for conducting the ELCM evap test (plot 1405), over time. Timeline 1400 further includes plot 1410, indicating whether the RV (e.g. 186) is in the first RV position or the second RV position, over time. Timeline 1400 further includes plot 1415, indicating whether the ELCM COV (e.g. 315) is in the first COV position, or the second COV position, over time. Timeline 1400 further includes plot 1420, indicating whether the ELCM pump (e.g. 330) is off, or is operating in the forward mode, also referred to as the vacuum-mode of operation, over time. Timeline 1400 further includes plot 1425, indicating pressure as monitored via the ELCM pressure sensor (e.g. 183), over time. Timeline 1400 further includes plot 1430, indicating pressure as monitored via the FTPT (e.g. 107), over time. Timeline 1400 further includes plot 1435, indicating whether the FTIV (e.g. 181) is commanded open, or closed, over time. Timeline 1400 further includes plot 1440, indicating whether the CPV (e.g. 158) is commanded open, or closed, over time. Timeline 1400 further includes plot 1445, indicating whether the CPV is indicated to be stuck closed (yes or no), over time. Timeline 1400 further includes plot 1450, indicating whether the CV1 and/or CV2 is indicated to be stuck open (yes or no), over time. Timeline 1400 further includes plot 1455, indicating whether the FTIV is indicated to be stuck open (yes or no), over time.

At time t0, conditions are not yet met for conducting the diagnostic (plot 1405). The RV is commanded to the first position (plot 1410), and the ELCM COV is commanded to the first COV position (plot 1415). The ELCM pump is off (plot 1420), and pressure as monitored via the ELCM pressure sensor (e.g. 183), is at atmospheric pressure. Furthermore, the FTIV is closed (plot 1435), yet pressure in the fuel tank is also near atmospheric pressure (plot 1430). The CPV is also closed (plot 1440) at time t0. At time t0, there is no indication that the CPV is stuck closed (plot 1445), there is no indication that the FTIV is stuck closed (plot 1455), and there is no indication that the CV1 and/or CV2 are stuck open (plot 1450).

At time t1, conditions are indicated to be met for conducting the diagnostic (refer to step 810 of method 800). Accordingly, the ELCM COV is maintained in the first COV position, and the ELCM pump is activated in the forward mode, also referred to herein as the vacuum-mode of operation. Accordingly, a vacuum is drawn across the reference orifice of the ELCM, and accordingly, between time t1 and t2, pressure as monitored via the ELCM pressure sensor becomes negative with respect to atmospheric pressure. By time t2, the pressure reduction has stabilized, and accordingly, the reference pressure is established, the reference pressure indicated by dashed line 1426.

With the reference pressure established at time t2, the ELCM pump is deactivated, and pressure rapidly returns to atmospheric pressure as monitored via the ELCM pressure sensor. Then, at time t3, the ELCM COV is commanded to the second COV position, the FTIV is commanded open, and the ELCM pump is reactivated in the forward mode. In this way, because the CPV is maintained closed, a vacuum is drawn on the fuel system and evaporative emissions system, up to the CPV. Between time t3 and t4, pressure in the fuel system and evaporative emissions system becomes negative with respect to atmospheric pressure, as monitored by the ELCM pressure sensor (plot 1425), and by the FTPT (plot 1435). By relying on both pressure sensors, it may be determined as to whether the FTIV is stuck closed or not. For example, if a vacuum develops as indicated by the ELCM pressure sensor, but no vacuum development is indicated by the FTPT, then it may be inferred that the FTIV is stuck closed.

At time t4, pressure as monitored by both the ELCM pressure sensor and the FTPT reaches the reference pressure, represented by dashed line 1426. Accordingly, while not explicitly illustrated, it may be understood that because the reference pressure was reached, an absence of undesired evaporative emissions stemming from the fuel system and/or evaporative emissions system is indicated.

Next, at time t4, the CPV is commanded open. Because the CV1 and CV2 valves are expected to close when a vacuum is applied on them from the ELCM pump operating in vacuum mode to draw a vacuum across the CPV, it may be understood that the act of opening the CPV may effectively increase a size of the space that the ELCM pump is evacuating. Accordingly, if the CV1 and CV2 are functioning as desired, and if the CPV is not stuck closed and instead opens when commanded to do so, a brief pressure change in the direction of atmospheric pressure may be expected. In other words, a pressure inflection point may be observed upon commanding open the CPV.

Indeed, between time t4 and t5, pressure changes in the direction of atmospheric pressure, as monitored by the ELCM pressure sensor (plot 1430) and as monitored via the FTPT (plot 1435). Accordingly, the CPV is not indicated to be stuck closed at time t5.

With the ELCM pump maintained on to evacuate the evaporative emissions system and fuel system, pressure as monitored via the ELCM pressure sensor and the FTPT again becomes more negative between time t5 and t6, again reaching the reference pressure by time t6. Accordingly, the neither the CV1 nor CV2 is indicated to be stuck open. At time t6, with the diagnostic having indicated the absence of undesired evaporative emissions, the fact that neither the FTIV nor the CPV is stuck closed, and the fact that neither the CV1 nor the CV2 is stuck open, conditions are no longer indicated to be met for conducting the diagnostic. Accordingly, the ELCM COV is commanded to the first COV position, and the ELCM pump is commanded off. The FTIV and the CPV are maintained open. Accordingly, pressure in the fuel system and evaporative emissions system rapidly returns to atmospheric pressure (refer to plots 1425 and 1430). Once the pressure in the fuel system and evaporative emissions system reaches atmospheric pressure at time t7, the CPV and FTIV are commanded closed. Accordingly, between time t7 and t8, pressure in the fuel system and pressure in the evaporative emissions system hovers around atmospheric pressure.

Turning now to FIG. 15, an example timeline 1500 is shown, illustrating how an engine-off boost test may be conducted, according to the methodology of FIG. 9. Timeline 1500 includes plot 1505, indicating whether conditions are met for conducting the engine-off boost test (yes or no), over time. Timeline 1500 further includes plot 1510, indicating whether the RV (e.g. 186) is commanded to the first RV position, or the second RV position, over time. Timeline 1500 further includes plot 1515, indicating whether the ELCM COV (e.g. 315) is commanded to the first COV position, or the second COV position, over time. Timeline 1500 further includes plot 1520, indicating whether the ELCM pump (e.g. 330) is commanded off, or is commanded to the reverse mode of operation, also referred to as the pressure mode of operation, over time. Timeline 1500 further includes plot 1525, indicating whether the EOBC valve (e.g. 189) is closed or open, over time. Timeline 1500 further includes plot 1530, indicating whether the CPV is open or closed, over time. Timeline 1500 further includes plot 1535, indicating whether the FTIV is open or closed, over time. Timeline 1500 further includes plot 1540, indicating pressure as monitored via the FTPT (e.g. 107), over time. Timeline 1500 further includes plot 1545, indicating whether there is an indication of ejector system degradation (yes or no), over time.

At time t0, conditions are not yet indicated to be met for conducting the engine-off boost test (plot 1505). The RV is in the first RV position (plot 1510), and the ELCM COV is in the first COV position (plot 1515). The ELCM pump is off (plot 1520), and the EOBC valve is closed (plot 1525). The CPV and the FTIV are both closed (refer to plots 1530 and 1535, respectively), and the FTPT is near atmospheric pressure (plot 1540). As of time t0, ejector system degradation is not yet indicated (plot 1545).

At time t1, conditions are indicated to be met for conducting the engine-off boost test (refer to step 910 of method 900). Accordingly, at time t2, the FTIV is commanded open. In this way, any pressure in the fuel tank may be relieve to atmosphere by way of the canister, with the RV in the first RV position and the ELCM COV in the first COV position.

At time t3, the RV is commanded to the second RV position. At time t4 the ELCM COV is commanded to the second COV position, the EOBC valve is commanded open, and the CPV is commanded open. Then, at time t5, the ELCM pump is activated in the reverse mode to direct a positive pressure with respect to atmospheric pressure through the EOBC, past the open EOBC valve, and to the ejector system, such that the ejector system may then communicate vacuum to the fuel system and evaporative emissions system via the open CPV and open FTIV.

Accordingly, between time t5 and t6, pressure in the fuel system and evaporative emissions system becomes negative with respect to atmospheric pressure (plot 1540), and at time t6 the vacuum build threshold, represented by dashed line 1541, is reached. Accordingly, ejector system degradation is not indicated at time t6.

With the vacuum build threshold having been reached at time t6, the ELCM pump is commanded off, and the ELCM COV is commanded to the first COV position. At time t7, the RV is commanded to the first RV position, thus coupling the fuel system and evaporative emissions system to atmosphere. Accordingly, between time t7 and t9, pressure in the fuel system and evaporative emissions system returns to atmospheric pressure. At time t8, while pressure is returning to atmospheric pressure, the EOBC valve is commanded closed. Once pressure reaches atmospheric pressure in the fuel system and evaporative emissions system at time t9, the FTIV is commanded closed. Pressure in the sealed fuel system hovers around atmospheric pressure between time t9 and t10.

In this way, an ejector system configured to deliver vacuum to a fuel system and/or evaporative emissions system under boosted engine operation, may be able to be diagnosed as to whether the ejector system if functioning as desired or expected, even under situations of reduced opportunity to conduct the diagnostic under boosted engine operation conditions. In other words, the diagnostics discussed herein may enable diagnosis of the ejector system functionality without relying on engine operation. The ability to conduct such an engine-off boost diagnostic on the ejector system may improve completion rates for ejector system diagnostics, particularly for hybrid vehicles with limited engine run time, and for vehicles for which boosted engine operation is infrequently encountered and/or where boosted engine operation timeframes are of a short duration (e.g. 1-3 seconds).

The technical effect is that by including a RV (e.g. 186) that enables an ELCM to be selectively fluidically coupled to the fuel vapor storage canister under certain conditions, and to the EOBC (e.g. 185) under other conditions, the ELCM may be selectively utilized to route positive pressure to the ejector system while the engine is off, which may enable diagnosing of the ejector system even when engine-on boost conditions are not encountered for particular drive cycles. Another technical effect is that by including the CV3 (e.g. 184), the positive pressure may be routed to the ejector system and not to the intake conduit. Yet another technical effect is that, by indicating that the CV3 is not stuck open, that the CPV is not stuck closed, that the FTIV is not stuck closed, that the EOBC valve is not stuck closed, that at least the CV1 is not stuck open, that the fuel system and evaporative emissions system are free from undesired evaporative emissions, and that the EOBC is not degraded, the directing of positive pressure to the ejector system and the subsequent monitoring of vacuum build in the fuel system and evaporative emissions system may enable the pinpointing of degradation to the ejector system.

The systems described herein, along with the methods discussed herein, may enable one or more systems and one or more methods. In one example, a method comprises while an engine of a vehicle is off and a set of predetermined conditions are met, directing a positive pressure with respect to atmospheric pressure into an ejector system to communicate a negative pressure with respect to atmospheric pressure on a fuel system and an evaporative emissions system; and indicating that the ejector system is degraded in response to the negative pressure not reaching a vacuum build threshold. In a first example of the method, the method further includes wherein directing the positive pressure into the ejector system further comprises commanding a routing valve to a second routing valve position to selectively couple a pump to the ejector system by way of an engine-off boost conduit; wherein commanding the routing valve to a first routing valve position alternatively selectively couples the pump to a vent line stemming from a fuel vapor storage canister positioned in the evaporative emissions system; and wherein responsive to the indication that the ejector system is degraded, preventing purging of fuel vapors from the fuel vapor storage canister under boosted engine operation conditions. A second example of the method optionally includes the first example, and further includes wherein directing the positive pressure into the ejector system further comprises commanding open an engine-off boost conduit valve positioned in the engine-off boost conduit upstream of the ejector system; and wherein the set of predetermined conditions includes at least an indication that the engine-off boost conduit is free from degradation, and an indication that the engine-off boost conduit valve is not stuck closed. A third example of the method optionally includes any one or more or each of the first through second examples, and further comprises a conduit that receives the positive pressure, the conduit positioned upstream of the ejector system, where the conduit includes a check valve positioned between the ejector system and an engine intake conduit, wherein the check valve functions to prevent the positive pressure from being communicated to the engine intake conduit; and wherein the set of predetermined conditions includes at least an indication that the check valve is not stuck open. A fourth example of the method optionally includes any one or more or each of the first through third examples, and further includes wherein directing the positive pressure to the ejector system to communicate the negative pressure with respect to atmospheric pressure on the fuel system and the evaporative emissions system further comprises: commanding open a canister purge valve positioned in a purge conduit that couples the evaporative emissions system to the ejector system; and wherein the set of predetermined conditions includes at least an indication that the canister purge valve is not stuck closed. A fifth example of the method optionally includes any one or more or each of the first through fourth examples, and further includes wherein directing the positive pressure to the ejector system to communicate the negative pressure with respect to atmospheric pressure on the fuel system and the evaporative emissions system further comprises: commanding open a fuel tank isolation valve that selectively fluidically couples the fuel system to the evaporative emissions system; and wherein the set of predetermined conditions includes at least an indication that the fuel tank isolation valve is not stuck closed. A sixth example of the method optionally includes any one or more or each of the first through fifth examples, and further includes wherein indicating that the ejector system is degraded in response to the negative pressure not reaching the vacuum build threshold further comprises monitoring the negative pressure via a pressure sensor positioned in the fuel system. A seventh example of the method optionally includes any one or more or each of the first through sixth examples, and further includes wherein the set of predetermined conditions includes at least an indication of an absence of a source of undesired evaporative emissions stemming from the fuel system and the evaporative emissions system. An eighth example of the method optionally includes any one or more or each of the first through seventh examples, and further comprises a first check valve positioned between an intake manifold of the engine and the evaporative emissions system; and wherein the set of predetermined conditions includes at least an indication that the first check valve is not stuck open. A ninth example of the method optionally includes any one or more or each of the first through eighth examples, and further includes wherein directing the positive pressure to the ejector system to communicate the negative pressure on the fuel system and the evaporative emissions system further comprises sealing the fuel system and the evaporative emissions system from atmosphere.

Another example of a method comprises during a condition where an engine of a vehicle is not combusting air and fuel, selectively fluidically coupling a pump positioned in a vent line stemming from a fuel vapor storage canister to an ejector system; routing a positive pressure with respect to atmospheric pressure into the ejector system via the pump in order to reduce a pressure in a fuel system and an evaporative emissions system of the vehicle; and indicating that the ejector system is not degraded responsive to the pressure in the fuel system and the evaporative emissions system being reduced to a vacuum build threshold. In a first example of the method, the method further includes wherein selectively fluidically coupling the pump to the ejector system further comprises commanding a routing valve from a first routing valve position to a second routing valve position, where the second routing valve position further comprises sealing the fuel system and the evaporative emissions system upstream of the fuel vapor storage canister from atmosphere. A second example of the method optionally includes the first example, and further comprises preventing the positive pressure from being routed into an engine intake conduit by a check valve positioned in a conduit upstream of the ejector system that receives the positive pressure being routed to the ejector system. A third example of the method optionally includes any one or more or each of the first through second examples, and further includes wherein routing the positive pressure to the ejector system further comprises an indication that the fuel vapor storage canister is substantially free from fuel vapors. A fourth example of the method optionally includes any one or more or each of the first through third examples, and further comprises capturing fuel vapors released from the fuel vapor storage canister during routing the positive pressure to the ejector system via an air intake hydrocarbon trap positioned in an intake manifold of the engine.

An example of a system for a vehicle comprises a pump that is selectively fluidically coupled to a vent line upstream of a fuel vapor storage canister positioned in an evaporative emissions system when a routing valve is commanded to a first routing valve position, and that is alternatively selectively fluidically coupled to an ejector system when the routing valve is commanded to a second routing valve position; and a controller with computer readable instructions stored on non-transitory memory that when executed during an engine-off condition, cause the controller to: command the routing valve to the second position, activate the pump to route a positive pressure to the ejector system; monitor a vacuum generated via the ejector system responsive to routing the positive pressure to the ejector system; and indicate that the ejector system is degraded responsive to the vacuum failing to reach or exceed a vacuum build threshold. In a first example of the system, the system may further comprise a fuel system selectively fluidically coupled to the evaporative emissions system via a fuel tank isolation valve, the fuel system including a fuel tank pressure transducer; and wherein the controller stores further instructions to command open the fuel tank isolation valve and monitor the vacuum generated via the ejector system via the fuel tank pressure transducer. A second example of the system optionally includes the first example, and further includes wherein the pump is fluidically coupled to the ejector system when the routing valve is commanded to the second routing valve position by way of an engine-off boost conduit, the engine-off boost conduit further including an engine-off boost conduit valve; and wherein the controller stores further instructions to command open the engine-off boost conduit valve in order to route the positive pressure to the ejector system. A third example of the system optionally includes any one or more or each of the first through second examples, and further comprises a conduit positioned upstream of the ejector system that receives the positive pressure that is routed to the ejector system; and wherein the conduit further includes a passive check valve that prevents the positive pressure from being routed to an intake conduit of an engine of the vehicle. A fourth example of the method optionally includes any one or more or each of the first through third examples, and further comprises a canister purge valve positioned in a purge conduit that couples the fuel vapor storage canister to an engine intake and to the ejector system; and wherein the controller stores further instructions to command open the canister purge valve when routing the positive pressure to the ejector system.

In another representation, a method comprises in a first condition, diagnosing an ejector system of a vehicle during boosted engine operation, and in a second condition, diagnosing the ejector system during an engine-off condition, where the second condition includes an indication that the first condition did not occur during a drive cycle just prior to the engine-off condition. In such a method, the first condition may include selectively coupling an ELCM pump to a vent line stemming from a fuel vapor storage canister by commanding a routing valve to a first routing valve position, and commanding an ELCM COV to a second position to seal the vent line from atmosphere. In such a method, the second condition may include selectively coupling the ELCM pump to the ejector system by way of an engine-off boost conduit, where the second condition further comprises commanding the routing valve to a second routing valve position and activating the ELCM pump to route a positive pressure with respect to atmospheric pressure to the ejector system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

while an engine of a vehicle is off and a set of predetermined conditions are met, directing a positive pressure with respect to atmospheric pressure into an ejector system to communicate a negative pressure with respect to atmospheric pressure on a fuel system and an evaporative emissions system; and indicating that the ejector system is degraded in response to the negative pressure not reaching a vacuum build threshold.

2. The method of claim 1, wherein directing the positive pressure into the ejector system further comprises commanding a routing valve to a second routing valve position to selectively couple a pump to the ejector system by way of an engine-off boost conduit;

wherein commanding the routing valve to a first routing valve position alternatively selectively couples the pump to a vent line stemming from a fuel vapor storage canister positioned in the evaporative emissions system; and wherein responsive to the indication that the ejector system is degraded, preventing purging of fuel vapors from the fuel vapor storage canister under boosted engine operation conditions.

3. The method of claim 2, wherein directing the positive pressure into the ejector system further comprises commanding open an engine-off boost conduit valve positioned in the engine-off boost conduit upstream of the ejector system; and wherein the set of predetermined conditions includes at least an indication that the engine-off boost conduit is free from degradation, and an indication that the engine-off boost conduit valve is not stuck closed.

4. The method of claim 1, further comprising a conduit that receives the positive pressure, the conduit positioned upstream of the ejector system, where the conduit includes a check valve positioned between the ejector system and an engine intake conduit, wherein the check valve functions to prevent the positive pressure from being communicated to the engine intake conduit; and wherein the set of predetermined conditions includes at least an indication that the check valve is not stuck open.

5. The method of claim 1, wherein directing the positive pressure to the ejector system to communicate the negative pressure with respect to atmospheric pressure on the fuel system and the evaporative emissions system further comprises:

commanding open a canister purge valve positioned in a purge conduit that couples the evaporative emissions system to the ejector system; and wherein the set of predetermined conditions includes at least an indication that the canister purge valve is not stuck closed.

6. The method of claim 1, wherein directing the positive pressure to the ejector system to communicate the negative pressure with respect to atmospheric pressure on the fuel system and the evaporative emissions system further comprises:

commanding open a fuel tank isolation valve that selectively fluidically couples the fuel system to the evaporative emissions system; and wherein the set of predetermined conditions includes at least an indication that the fuel tank isolation valve is not stuck closed.

7. The method of claim 1, wherein indicating that the ejector system is degraded in response to the negative pressure not reaching the vacuum build threshold further comprises monitoring the negative pressure via a pressure sensor positioned in the fuel system.

8. The method of claim 1, wherein the set of predetermined conditions includes at least an indication of an absence of a source of undesired evaporative emissions stemming from the fuel system and the evaporative emissions system.

9. The method of claim 1, further comprising a first check valve positioned between an intake manifold of the engine and the evaporative emissions system; and wherein the set of predetermined conditions includes at least an indication that the first check valve is not stuck open.

10. The method of claim 1, wherein directing the positive pressure to the ejector system to communicate the negative pressure on the fuel system and the evaporative emissions system further comprises sealing the fuel system and the evaporative emissions system from atmosphere.

11. A method comprising:

during a condition where an engine of a vehicle is not combusting air and fuel, selectively fluidically coupling a pump positioned in a vent line stemming from a fuel vapor storage canister to an ejector system;

routing a positive pressure with respect to atmospheric pressure into the ejector system via the pump in order to reduce a pressure in a fuel system and an evaporative emissions system of the vehicle; and indicating that the ejector system is not degraded responsive to the pressure in the fuel system and the evaporative emissions system being reduced to a vacuum build threshold.

12. The method of claim 11, wherein selectively fluidically coupling the pump to the ejector system further comprises commanding a routing valve from a first routing valve position to a second routing valve position, where the second routing valve position further comprises sealing the fuel system and the evaporative emissions system upstream of the fuel vapor storage canister from atmosphere.

13. The method of claim 11, further comprising preventing the positive pressure from being routed into an engine intake conduit by a check valve positioned in a conduit upstream of the ejector system that receives the positive pressure being routed to the ejector system.

14. The method of claim 11, wherein routing the positive pressure to the ejector system further comprises an indication that the fuel vapor storage canister is substantially free from fuel vapors.

15. The method of claim 11, further comprising capturing fuel vapors released from the fuel vapor storage canister during routing the positive pressure to the ejector system via an air intake hydrocarbon trap positioned in an intake manifold of the engine.

16. A system for a vehicle, comprising:

a pump that is selectively fluidically coupled to a vent line upstream of a fuel vapor storage canister positioned in an evaporative emissions system when a routing valve is commanded to a first routing valve position, and that is alternatively selectively fluidically coupled to an ejector system when the routing valve is commanded to a second routing valve position; and a controller with computer readable instructions stored on non-transitory memory that when executed during an engine-off condition, cause the controller to:

command the routing valve to the second position, activate the pump to route a positive pressure to the ejector system;

monitor a vacuum generated via the ejector system responsive to routing the positive pressure to the ejector system; and indicate that the ejector system is degraded responsive to the vacuum failing to reach or exceed a vacuum build threshold.

17. The system of claim 16, further comprising a fuel system selectively fluidically coupled to the evaporative emissions system via a fuel tank isolation valve, the fuel system including a fuel tank pressure transducer; and wherein the controller stores further instructions to command open the fuel tank isolation valve and monitor the vacuum generated via the ejector system via the fuel tank pressure transducer.

18. The system of claim 16, wherein the pump is fluidically coupled to the ejector system when the routing valve is commanded to the second routing valve position by way of an engine-off boost conduit, the engine-off boost conduit further including an engine-off boost conduit valve; and wherein the controller stores further instructions to command open the engine-off boost conduit valve in order to route the positive pressure to the ejector system.

19. The system of claim 16, further comprising a conduit positioned upstream of the ejector system that receives the positive pressure that is routed to the ejector system; and wherein the conduit further includes a passive check valve that prevents the positive pressure from being routed to an intake conduit of an engine of the vehicle.

20. The system of claim 16, further comprising a canister purge valve positioned in a purge conduit that couples the fuel vapor storage canister to an engine intake and to the ejector system; and wherein the controller stores further instructions to command open the canister purge valve when routing the positive pressure to the ejector system.

* * * * *